US007025588B2

(12) United States Patent
Laforest et al.

(10) Patent No.: US 7,025,588 B2
(45) Date of Patent: Apr. 11, 2006

(54) UTILITY LIGHTER

(75) Inventors: Guy Laforest, Cascais (PT); Paul Adams, Monroe, CT (US); Brian Tubby, Milford, CT (US); Richard M. Orazietti, Derby, CT (US); Floyd B. Fairbanks, Naugatuck, CT (US)

(73) Assignee: BIC Corporation, Milford, CT (US)

( * ) Notice: Subject to any disclaimer, the term of this patent is extended or adjusted under 35 U.S.C. 154(b) by 79 days.

(21) Appl. No.: 10/860,904

(22) Filed: Jun. 4, 2004

(65) Prior Publication Data

US 2004/0219467 A1 Nov. 4, 2004

Related U.S. Application Data

(63) Continuation of application No. 10/347,393, filed on Jan. 21, 2003, now Pat. No. 6,746,234, which is a continuation of application No. 09/312,609, filed on May 17, 1999, now Pat. No. 6,527,546, which is a continuation-in-part of application No. 08/917,134, filed on Aug. 25, 1997, now Pat. No. 6,086,360, which is a continuation-in-part of application No. 08/787,399, filed on Jan. 22, 1997, now Pat. No. 5,934,895.

(51) Int. Cl.
*F23Q 2/28* (2006.01)

(52) U.S. Cl. ..... 431/153; 431/255

(58) Field of Classification Search ..... 431/153, 431/255, 277, 276, 254, 256, 258, 344, 345, 431/142

See application file for complete search history.

(56) References Cited

U.S. PATENT DOCUMENTS

| | | | | |
|---|---|---|---|---|
| 3,520,647 | A | 7/1970 | Poppel | 431/254 |
| 3,580,698 | A | 5/1971 | Goto | 431/255 |
| 3,894,273 | A | 7/1975 | Newport, Jr. et al | 317/96 |
| 3,947,731 | A | 3/1976 | Vainer | 317/81 |
| 4,069,006 | A | 1/1978 | Jackson | 431/344 |
| 4,220,443 | A | 9/1980 | Bear | 431/91 |
| 4,253,818 | A | 3/1981 | Ogawa et al. | 431/142 |
| 4,253,820 | A | 3/1981 | Jarreau | 431/344 |
| 4,259,059 | A | 3/1981 | Roosa et al. | 431/254 |
| 4,273,528 | A | 6/1981 | Göbelt | 431/255 |
| 4,288,209 | A | 9/1981 | Yoshinaga | 431/255 |
| 4,292,021 | A | 9/1981 | Miyagawa | 431/13 |
| 4,389,187 | A | 6/1983 | Sims | 431/277 |
| 4,403,946 | A | 9/1983 | Kagawa | 431/255 |
| 4,462,791 | A | 7/1984 | Hayden | 431/345 |

(Continued)

FOREIGN PATENT DOCUMENTS

| | | |
|---|---|---|
| CN | 258234 | 4/1995 |

(Continued)

OTHER PUBLICATIONS

Supermatch FLX Operating Instructions and Warranty for Model 10504, Zelco Products, 2 pages.

*Primary Examiner*—Josiah C. Cocks
(74) *Attorney, Agent, or Firm*—Jones Day

(57) ABSTRACT

The present invention relates to a lighter including a housing having a handle at one end and a nozzle at another end and including a fuel supply connected for selective fluid communication with the nozzle. A release member is cooperatively connected to the housing to initiate the flow of fuel from the fuel supply to the nozzle. An ignitor, such as a piezoelectric mechanism, is provided for generating a spark proximate the nozzle. A trigger spaced from the release member is operatively connected to the housing for actuating the ignitor for the generation of a spark igniting the fuel present at the nozzle.

43 Claims, 20 Drawing Sheets

U.S. PATENT DOCUMENTS

| | | | | |
|---|---|---|---|---|
| 4,516,933 | A | 5/1985 | Buzzi | 431/255 |
| 4,538,983 | A | 9/1985 | Zeller et al. | 431/255 |
| 4,569,654 | A | 2/1986 | Borghesi | 431/255 |
| 4,610,624 | A | 9/1986 | Bruhn | 431/255 |
| 4,635,382 | A | 1/1987 | Bourdeau | 34/97 |
| 4,691,691 | A | 9/1987 | Patenaude | 126/414 |
| 4,699,123 | A | 10/1987 | Zaborowski | 126/409 |
| 4,778,380 | A | 10/1988 | Nitta | 431/255 |
| 4,832,595 | A | 5/1989 | Eads | 431/89 |
| 4,854,859 | A | 8/1989 | Lin | 431/344 |
| 4,919,111 | A | 4/1990 | Ohsawa | 126/25 B |
| 5,059,852 | A | 10/1991 | Meury | 310/339 |
| 5,066,220 | A | 11/1991 | Vick | 431/153 |
| 5,092,764 | A | 3/1992 | McDonough et al. | 431/277 |
| 5,135,388 | A | 8/1992 | Pettit | 431/254 |
| 5,154,483 | A | 10/1992 | Zeller | 362/198 |
| 5,154,601 | A | 10/1992 | Capilla | 431/255 |
| 5,186,618 | A | 2/1993 | Shike et al. | 431/153 |
| 5,199,865 | A | 4/1993 | Liang | 431/255 |
| 5,222,889 | A | 6/1993 | Hsu | 431/255 |
| 5,262,697 | A | 11/1993 | Meury | 310/339 |
| 5,284,439 | A | 2/1994 | Shike et al. | 431/263 |
| D345,489 | S | 3/1994 | Moh | D7/416 |
| 5,304,060 | A | 4/1994 | Lin | 431/255 |
| 5,308,240 | A | 5/1994 | Lowenthal | 431/255 |
| 5,322,433 | A | 6/1994 | Shike et al. | 431/266 |
| 5,326,256 | A | 7/1994 | Shike et al. | 431/255 |
| 5,348,467 | A | 9/1994 | Piffath et al. | 431/153 |
| 5,369,556 | A | 11/1994 | Zeller | 362/198 |
| 5,412,179 | A | 5/1995 | Chen | 219/262 |
| 5,417,571 | A | 5/1995 | Kvalseth | 431/153 |
| 5,427,522 | A | 6/1995 | McDonough et al. | 431/153 |
| D362,313 | S | 9/1995 | Zeller | D26/43 |
| 5,460,521 | A | 10/1995 | Tsai | 431/255 |
| 5,478,232 | A | 12/1995 | Dillinger et al. | 431/255 |
| 5,496,169 | A | 3/1996 | Chen | 431/153 |
| 5,505,614 | A | 4/1996 | Lin | 431/143 |
| 5,531,592 | A | 7/1996 | Tasi | 431/255 |
| 5,545,035 | A | 8/1996 | Tsai | 431/255 |
| 5,550,420 | A | 8/1996 | Hsu | 310/339 |
| 5,564,918 | A | 10/1996 | Lin | 431/255 |
| 5,564,919 | A | 10/1996 | Tsai | 431/255 |
| 5,616,022 | A | 4/1997 | Moran, IV | 431/253 |
| 5,620,318 | A | 4/1997 | Tsai | 431/344 |
| 5,655,901 | A | 8/1997 | Makoto | 431/153 |
| 5,662,466 | A | 9/1997 | Cheng | 431/153 |
| 5,697,775 | A | 12/1997 | Saito et al. | 431/153 |
| 5,704,776 | A | 1/1998 | Sher | 431/153 |
| 5,738,507 | A | 4/1998 | Mifune et al. | 431/344 |
| 5,741,128 | A | 4/1998 | Tsai | 431/255 |
| 5,771,880 | A | 6/1998 | Tsai | 126/414 |
| 5,772,423 | A | 6/1998 | Mandir | 431/254 |
| 5,839,892 | A | 11/1998 | Hwang | 431/153 |
| 5,865,614 | A | 2/1999 | Hsu | 431/255 |
| 5,897,308 | A | 4/1999 | Saito et al. | 431/153 |
| 5,931,656 | A | 8/1999 | Kanno | 431/153 |
| 5,967,768 | A | 10/1999 | Saito et al. | 431/153 |
| 5,980,242 | A | 11/1999 | Man | 431/344 |
| 5,997,282 | A | 12/1999 | Man | 431/153 |
| 6,010,328 | A | 1/2000 | Sung | 431/153 |
| 6,050,810 | A | 4/2000 | Huang | 431/153 |
| 6,086,359 | A | 7/2000 | Sher | 431/153 |
| 6,135,763 | A | 10/2000 | Man | 431/153 |
| 6,168,420 | B1 | 1/2001 | Sung | 431/153 |
| 6,186,773 | B1 | 2/2001 | Sung | 431/153 |
| 6,213,759 | B1 | 4/2001 | Sung | 431/153 |
| 6,315,550 | B1 | 11/2001 | Sher | 431/153 |
| 6,318,992 | B1 | 11/2001 | Sung | 431/153 |
| 6,325,617 | B1 | 12/2001 | Sung | 431/153 |
| 6,332,771 | B1 * | 12/2001 | Adams et al. | 431/255 |
| 6,332,772 | B1 | 12/2001 | Sung | 431/153 |
| 6,468,070 | B1 | 10/2002 | Jon | 431/153 |
| 6,488,493 | B1 | 12/2002 | Sung | 431/153 |
| 6,527,546 | B1 * | 3/2003 | Laforest et al. | 431/255 |
| 6,746,234 | B1 * | 6/2004 | Laforest et al. | 431/153 |
| 2001/0023054 | A1 | 9/2001 | Sung | 431/153 |
| 2001/0044085 | A1 | 11/2001 | Sung | 431/153 |
| 2002/0061488 | A1 | 5/2002 | Sung | 431/143 |

FOREIGN PATENT DOCUMENTS

| | | |
|---|---|---|
| DE | 1 025 122 | 10/1954 |
| EP | 0 732 545 A1 | 9/1996 |
| GB | 2 156 499 | 10/1985 |
| JP | 54-36882 | 8/1977 |
| JP | 54-159069 | 5/1978 |
| JP | 61-143620 | 10/1985 |
| JP | 64-10027 | 7/1987 |
| RU | 2036387 | 5/1995 |
| WO | WO 98/31774 | 7/1998 |

* cited by examiner

UTILITY LIGHTER

CROSS-REFERENCE TO RELATED APPLICATIONS

The present application is a continuation of U.S. application Ser. No. 10/347,393, filed Jan. 21, 2003, now U.S. Pat. No. 6,746,234 which is a continuation of U.S. application Ser. No. 09/312,609, filed May 17, 1999, now U.S. Pat. No. 6,527,546, which is a continuation-in-part of both U.S. application Ser. No. 08/787,399, filed Jan. 22, 1997, now U.S. Pat. No. 5,934,895, and U.S. application Ser. No. 08/917,134, filed Aug. 25, 1997, now U.S. Pat. No. 6,086,360, the entire contents of which are hereby incorporated by reference.

TECHNICAL FIELD

The present invention generally relates to general purpose utility lighters such as those used to ignite candles, barbecue grills, fireplaces and campfires.

BACKGROUND OF THE INVENTION

Lighters used for igniting tobacco products, such as cigars, cigarettes, and pipes, have developed over a number of years. Typically, these lighters use either a rotary friction element or a piezoelectric element to generate a spark in proximity to a nozzle emitting fuel from a fuel container. Piezoelectric mechanisms have gained universal acceptance. One such piezoelectric mechanism is disclosed in U.S. Pat. No. 5,262,697 ("the '697 patent"). The disclosure of the '697 patent is incorporated by reference herein.

Lighters have also evolved from the small, hand-held lighters to several forms of extended lighters. These lighters are also hand held, but are more useful for general purposes such as lighting candles, barbecue grills, fireplaces and campfires. Earlier attempts at such designs relied simply on extended actuating handles to house a typical lighter at the end. Examples of this concept are found in U.S. Pat. Nos. 4,259,059 and 4,462,791.

In addition, many utility lighters have incorporated some form of operating mechanism to prevent unintentional operation of the lighter. Often, these mechanisms take the form of on/off switches that may prevent activation of the lighter. However, the on/off switches that must be positively moved by the user between "on" and "off" positions have drawbacks. For example, an adult user may forget to move the switch back to the "off" position after use and thereby render the on/off switch ineffective.

The prior art extended utility lighters typically have a trigger mechanism, which actuates both the fuel source and the ignitor mechanism. An example of such a system is disclosed in U.S. Pat. No. 5,3269,256. In this lighter, the fuel release and spark generation are initiated by a single motion. In contrast, requiring separate and distinct motions for releasing gas and for actuating the piezoelectric mechanism would increase the difficulty of operating the extended utility lighter.

Thus, there remains a need for a utility lighter having a greater level of resistance for unintended users by requiring multiple movements or motions by the user to activate the lighter.

SUMMARY OF THE INVENTION

The present invention relates to lighters having greater level of resistance for unintended users. The lighter comprises a housing with a nozzle having an outlet, and a fuel supply in communication with a fuel conduit adapted for selective release of fuel to the nozzle outlet. A valve actuator is included for engaging a valve to release fuel. A release member is included, and is slidably supported by the housing at a first end and unsupported at a second end such that an intended user may act on the second end of the release member and then slide the release member to engage the valve to release fuel. A trigger extends from the housing and is operatively connected to an ignitor to produce a spark to ignite the released fuel. The release member and the trigger are configured such that the intended user may release the fuel and produce the spark at substantially the same time to produce a flame.

In another embodiment, the release member has a cam surface adapted to act on the valve actuator to release fuel, such that the intended user may act on the second end to selectively release fuel. In another embodiment, the user may move the trigger in a first direction and then in second direction to produce a spark to ignite the selectively released fuel. In yet another embodiment, the lighter includes a release member biased against a stop member on the housing to restrict the fuel conduit. The release member is actuatable by a user to remove the restriction on the fuel conduit and to selectively release fuel. These features and other features are fully described and claimed herein.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION

Figure 1:
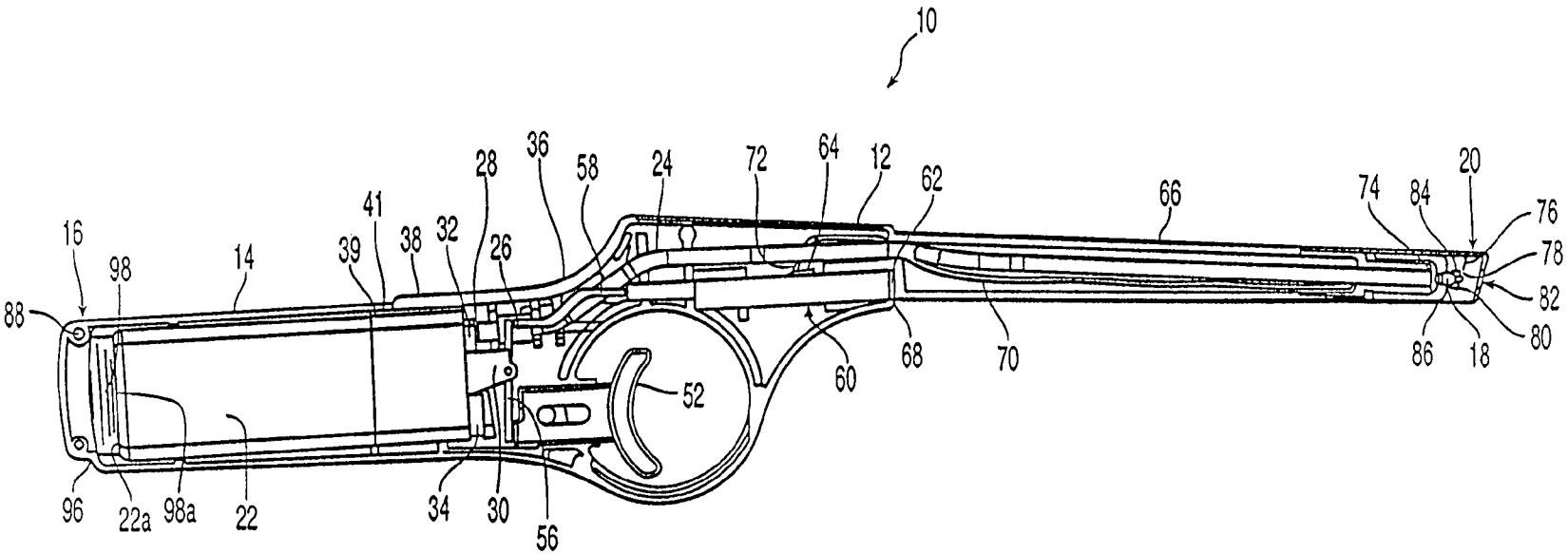
FIG. 1 is a side view of the utility lighter of this invention opened up and with certain components omitted to show various inner elements thereof.

Turning to FIG. 1, a preferred embodiment of a utility lighter 10 constructed in accordance with the present invention generally includes a housing 12 which may primarily be formed of a molded rigid polymer or plastic materials such as acrylonitrile butadiene styrene terpolymer (ABS), or the like. Housing 12 includes a handle 14 disposed toward the back of the lighter 10, proximate to a first end 16. It should be noted that the term back, as used herein, refers to that portion which is closest to first end 16 and the term front, as used herein, refers to that portion which is closest to a second end 20 of lighter 10. It will be noted that the terms first end 16 and second end 20 are used to describe the preferred embodiments and form no part of the present invention.

A nozzle 18 is disposed proximate the second end 20 for emitting fuel to sustain a flame as will be described herein. Handle 14 preferably contains a fuel supply container 22, which may be a conventional butane fuel cell. A fuel conduit 24, such as a plastic tube, is fixed to a fluid connector 26 at one end, which is positioned next or connected to a valve 28 on fuel supply container 22. The opposite end of conduit 24 terminates at nozzle 18. Nozzle 18 may include a diffuser spring affixed thereto and acts as an electrode. It is preferably formed of an electrically conductive material such as brass or zinc. A diffuser spring can be an electrically conductive coil spring, where the space between the adjacent coils of the spring is designed to allow air to mix with the released fuel to ensure a proper air/fuel mixture suitable for combustion.

Figure 2:
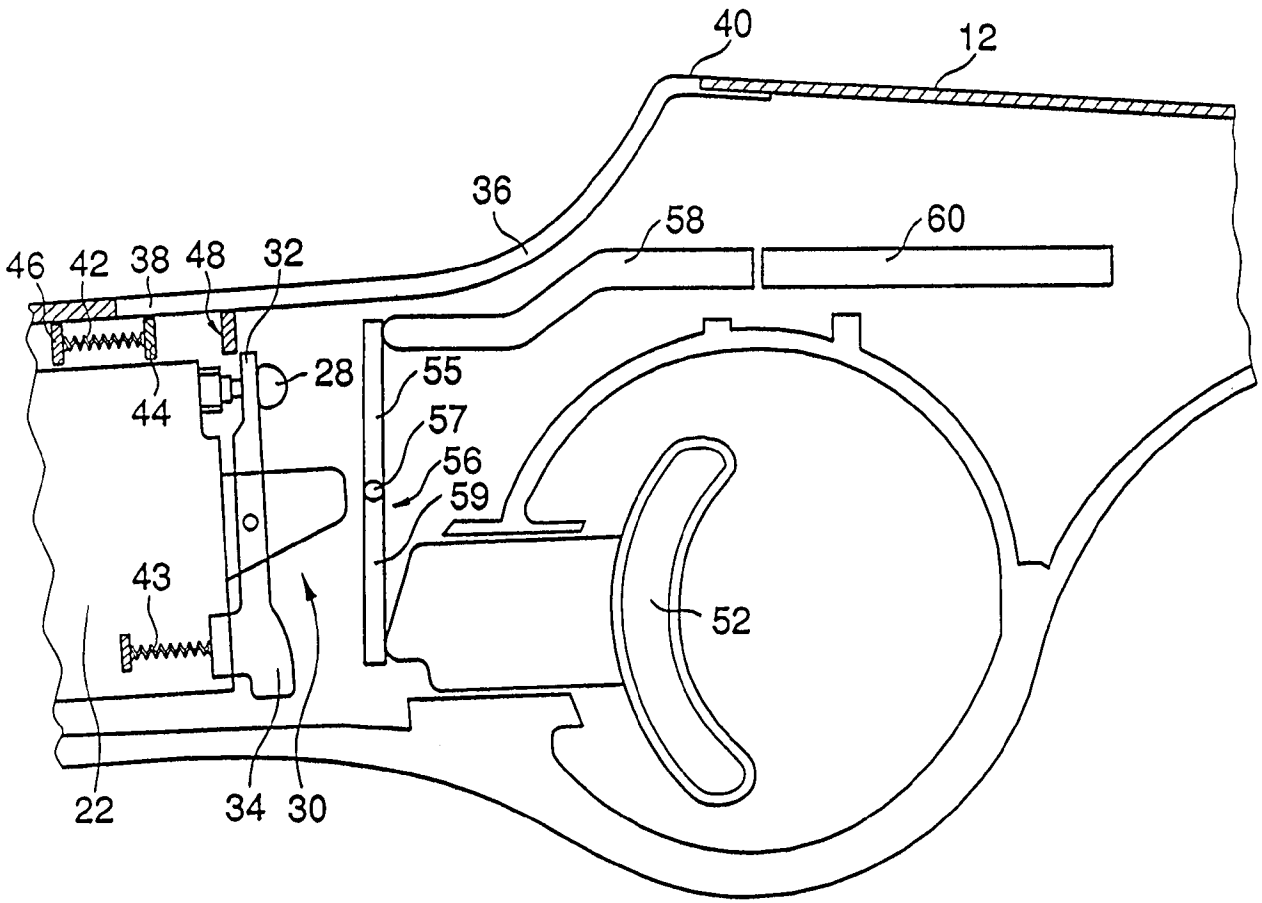
FIG. 2 is an enlarged and partially fragmented side view similar to FIG. 1 but with certain components omitted to show the release member, valve actuator, ignitor and trigger.

Valve 28 is operable by a valve actuator 30, which is pivotally attached to fuel supply container 22, better shown in FIG. 2. The valve actuator 30 has a lift end 32 and a push end 34. Thus, when valve actuator 30 is pivoted, i.e., when forced is applied to lift the lift end 32 or depress the push end 34, fuel is released by valve 28 through connector 26 and fuel conduit 24, and finally to nozzle 18. A suitable fuel supply container 22 is disclosed in U.S. Pat. No. 5,520,197 ("the '197 patent"). The disclosure of the '197 patent is incorporated herein by reference in its entirety.

Figure 3:
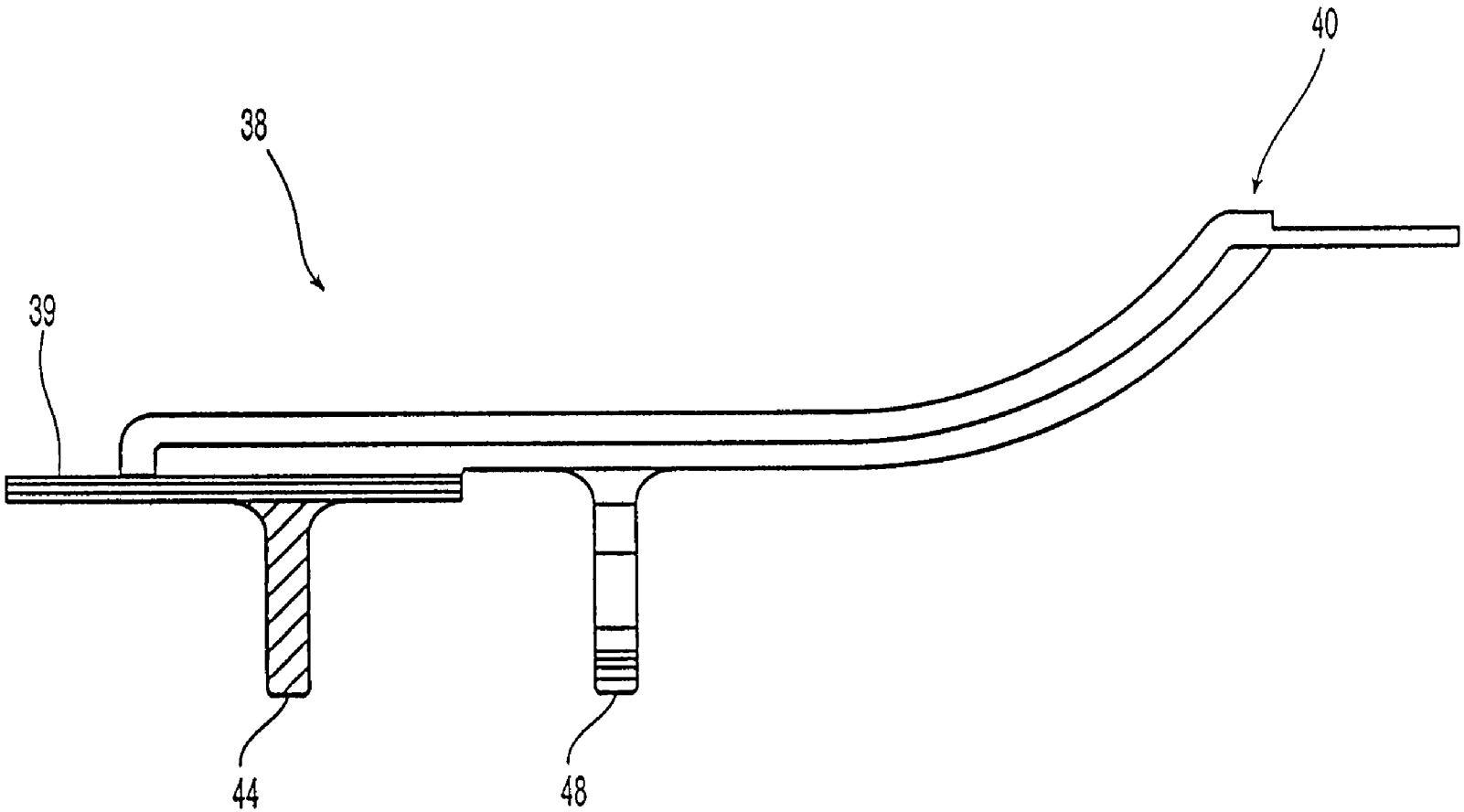
FIG. 3 is a side view of a release member.

A release member 36 is provided to facilitate operation of the valve actuator 30. The release member 36 is resiliently biased toward the first end 16 of the housing 12 and has a back end 38 with a flange portion 39 fixed thereto. Release member 36 is preferably made from a resilient material, such as acetal, or another plastic supported by a spring. Flange 39 is dimensioned and configured to be received in a corresponding channel 41 on handle 14, as shown in FIGS. 1 and 3. Specifically, flange 39 is slidable with respect to channel 41 in the front-back direction, but is not allowed to move in a direction transverse thereto. The release member 36 also has a second end 40, located opposed to back end 38, abutting the housing 12. Second end 40 remains unconnected to the housing 12 and may be resiliently depressed downward into the interior of the lighter. The downward depression of second end 40 is possible because the movement of the back end 38 is restricted to channel 41, such that the back end 38 provides a cantilever support for release member 36.

While other types of resilient members or springs can be used, a metal coil spring 42 preferably connects one end of the release member 36 to handle 14 as shown in FIG. 2. More preferably, the release member 36 is resiliently biased by coil spring 42 secured between a spring tab 44 on release member 36 and a spring stopper 46 on the handle. The release member 36 further includes a release tab 48 for actuating the valve actuator 30. In this configuration, the release member 36 is depressable at second end 40 toward the interior of the lighter, and slidable toward the second end 20 of the housing 12 to release fuel gas.

As shown in FIG. 2, which illustrates the release member 36 in an inoperative state, release tab 48 is not engaging end 32 of the valve actuator 30. Thus, even if the user slides the release member 36 forward toward second end 20, tab 48 does not engage with lift end 32 to lift the valve 28 to release fuel. To release fuel, a user should first depress second end 40 of release member 36 such that release tab 48 engages lift end 32 prior to pushing release member 36 forward to release fuel.

It will be noted that valve 28 can be either a normally open valve or a normally closed valve. A normally open valve is a valve that normally allows fuel to be released, unless pressure is applied to the valve to close the valve. A compression spring 43 is provided, as shown in FIGS. 2, 4, 4A, 4B, 5, 7, 8, 8A, 9, 9A, 10, 10A, 11 and 11A to exert a pressure on push end 34, which in turn presses lift end 32 to close valve 28.

On the other hand, a normally closed valve is a valve that normally shuts off the release of fuel. Pressure is applied to the valve to open the same to release the fuel. After the pressure is released, the valve automatically closes to cutoff fuel release. A compression spring 43 may be provided to bias lift end 32 in a direction opposite to the release direction.

A trigger 52 is also provided to facilitate the spark generation at the nozzle 18. The trigger 52 extends from the handle 14 of the lighter 10. The trigger 52 is adapted to act on a first end 59 of a linking arm 56, which is rotatably secured to the housing 12 on a pin 57. The second end 55 of linking arm 56 acts on a linking rod 58, which is operatively connected to activate an ignitor 60. Preferably, linking arm 56 and linking rod 58 are mounted to the housing 12 in a biased manner such that the linking arm 56 is biased in a counterclockwise direction and the linking rod 58 is slidable in the back-to-front direction, as shown in FIG. 2. For example, a return spring in a piezoelectric mechanism may be used to bias the linking rod 58 and linking arm 56 in the counterclockwise direction. Trigger 52 is depressable by a user toward the first end 16 of the lighter 10 to generate a spark. Trigger 52 acts on first end 59 of linking arm 56 which rotates second end 55 toward linking rod 58 in a clockwise direction to compress electric ignitor 60 to generate a spark. Trigger 52 can be replaced with a squeeze mechanism such that when pressure is applied to handle 14 in a specific direction, one handle portion pivots with respect to another portion to activate the ignitor assembly 60.

Although not necessary for all aspects of this invention, an electric ignitor 60 such as a piezoelectric mechanism is the preferred ignitor assembly. A piezoelectric mechanism has been illustrated in FIGS. 1–2 schematically and particularly described in the '697 patent. The details necessary to an understanding of this invention have been shown in the drawings. In summary, however, a piezoelectric mechanism is a telescopic assembly which may be compressed to generate a voltage between first and second electrical contacts 62, 64. The telescopic assembly generally comprises two telescopic members separated by a biasing return spring.

Specifically, piezoelectric mechanism 60 contains a piezoelectric crystal in electrical contact with and generally situated between first and second electrical contacts 62 and 64. Electrical contact 62 is generally referred to as an anvil, and electrical contact 64 contacts an impact pad positioned on an opposite side of the piezoelectric crystal. First electrical contact 62 is in direct contact with an electrically conductive wand 66, which is disposed on the outside portion of housing 12 at junction location 68, as illustrated in FIGS. 1 and 2.

Conductive wand 66 is preferably made out of metal, which may be disposed over a portion of housing 12. Second electrical contact 64 is preferably connected to an insulated wire 70 having two exposed ends 72 and 74. Exposed end 72 is connected to contact 64 while exposed end 74 is connected to nozzle 18. Nozzle 18 and/or diffuser spring therefore act as an electrode. At the front end of the conductive wand 66, a tab or antenna 76, is stamped from wand 66 proximate second end 20 to create a spark gap 78 with an outlet 80 of nozzle 18. An opening 82 at the end of conductive wand 66 allows the passage of ignited fuel from the lighter 10. Also, in a conventional manner, side apertures 84, only one of which is shown in FIG. 1, may be provided to allow the intake of air.

An electrically insulating cap 86 is disposed around at least a portion of nozzle 18 and generally between nozzle 18 and conductive wand 66. This electrically insulating cap 86 deters sparks from being generated between nozzle 18 and any surfaces of conductive wand 66 other than the tab 76.

The operation of lighter 10 will now be described generally with reference to FIG. 1. With one hand, a user grasps handle 14 with the thumb on front end 40 of release member 36 and the index finger on trigger 52. The thumb depresses the front end 40 of the release member 36 downwardly while sliding the release member 36 forward toward second end 20 of the housing 12. The depressed release member 36 pivots downward and moves forward toward the second end 20 of the housing 12, initiating a similar downward and forward movement for the associated release tab 48. The downward movement engages the release tab 48 with lift end 32 of the valve actuator 30, and the forward movement of the release tab 48 slides the lift end 32 forward to lift the valve 28 to release fuel. Gaseous fuel, such as butane, is thereby released from nozzle 18 at the nozzle outlet 80.

Thereafter, the user may pull the trigger 52, which rotates the linking arm 56, moves the linking rod 58 forward and compresses piezoelectric mechanism 60, to generate a voltage between electrical contacts 62 and 64. Electrical current passes from contact 62 into electrically conductive wand 66 and from contact 64 into wire 70, which is connected to electrically conductive nozzle 18. A spark is thereby generated in spark gap 78 to ignite the released fuel. The ignited fuel therefore passes through hole 82. As long as the user depresses front end 40 of release member 36 to sustain the fuel release, the trigger 52 may be repeatedly pulled and the piezoelectric mechanism 60 repeatedly actuated to generate a spark to ignite the released fuel in the event that the first actuation does not produce a flame. Although not necessary to practice this invention, preferably the gas is released before the actuation of the piezoelectric ignitor, so that fuel can travel down conduit 24 and reach the nozzle when a spark is generated.

As shown in FIG. 2, when the user releases the release member 36, spring 42 biases the release member 36 backward toward the first end 16 and tab 48 disengages from lift end 32 of valve actuator 30. Compression spring 43 biases valve actuator 30 such that end 32 acts on valve 28 thereby closing and shutting off the supply of fuel to nozzle 18. This extinguishes the flame emitted from the hole 82. After pressure is released, front end 40 of release member 36 also moves upward and disengages release tab 48 from lift end 32. Due to the cantilever connection between back end 38 and handle 14, front end 40 of release member 36 is normally biased in this upward position. Operating both the release member 36 and the trigger 52 in sequence with respect to each other increases the skills required to operate the lighter 10 and thereby elevating the level of difficulty associated with its use.

Additionally, to prevent forward movement of release member 36 without depressing front end 40, front end 40 may be configured and dimensioned to abut housing 12 in the inoperative state, as shown in FIG. 1.

Figure 2A:
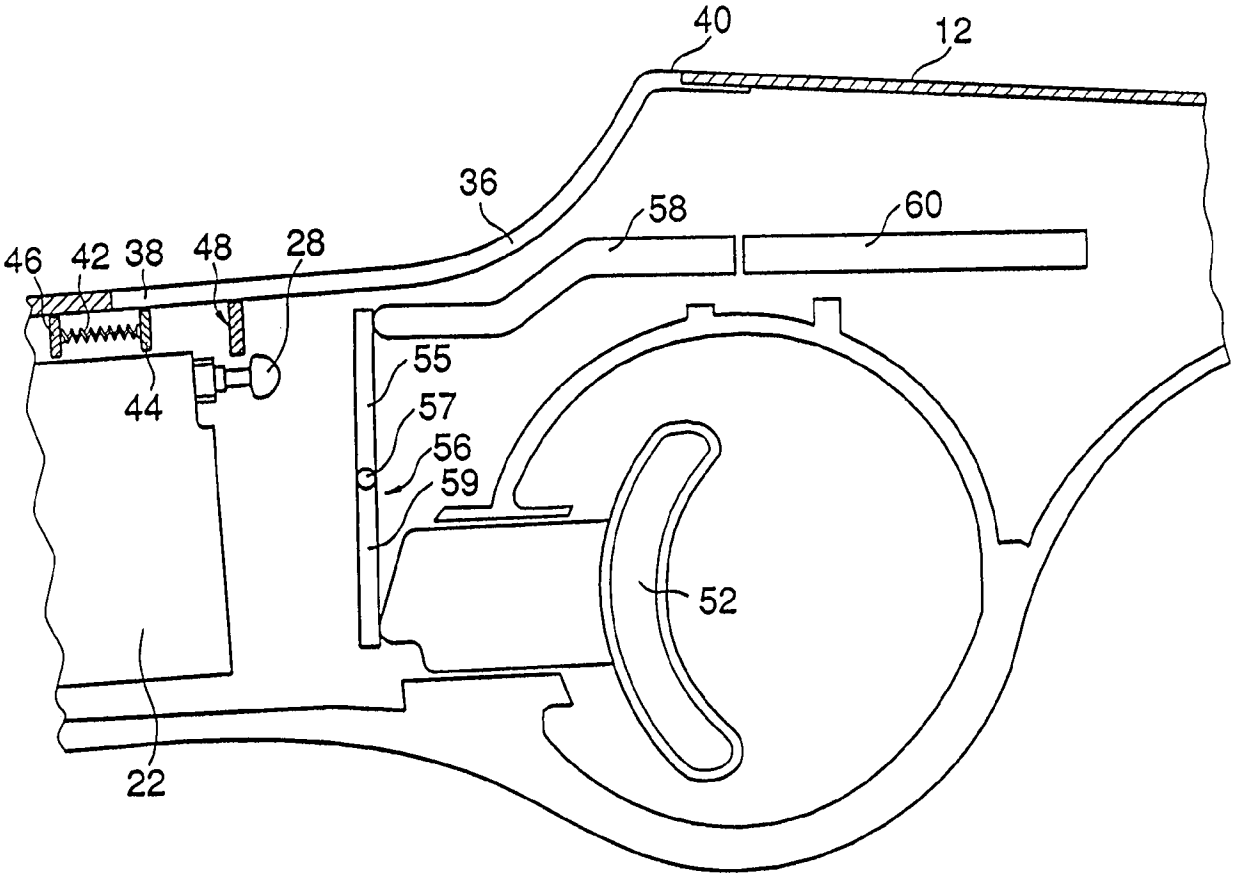
FIG. 2*a* is substantially similar to FIG. 2, showing another embodiment without the valve actuator.

Alternatively, as shown in FIG. 2*a*, release member 36 can be used without valve actuator 30. In this embodiment, release tab 48 is configured and dimensioned to engage valve 28 to lift the same to release fuel. For example, release tab 48 may have a fork end adapted to engage the tip of valve 28. Thus, depressing front end 40 engages release tab 48 with valve 28, and the subsequent forward motion of release member 36 allows the release tab 48 to open the valve 28 and release the fuel. As can be appreciated by one of ordinary skill in the art, this embodiment of release member 36 is readily usable with a normally closed valve 28, because as release tab 48 is released, valve 28 is automatically shut-off. This embodiment can also be used with a normally open valve, if release tab 48 permanently engages valve 28 such that the biasing action of spring 42 on release member 36 exerts sufficient pressure on valve 28 to shut-off fuel.

Figure 4:
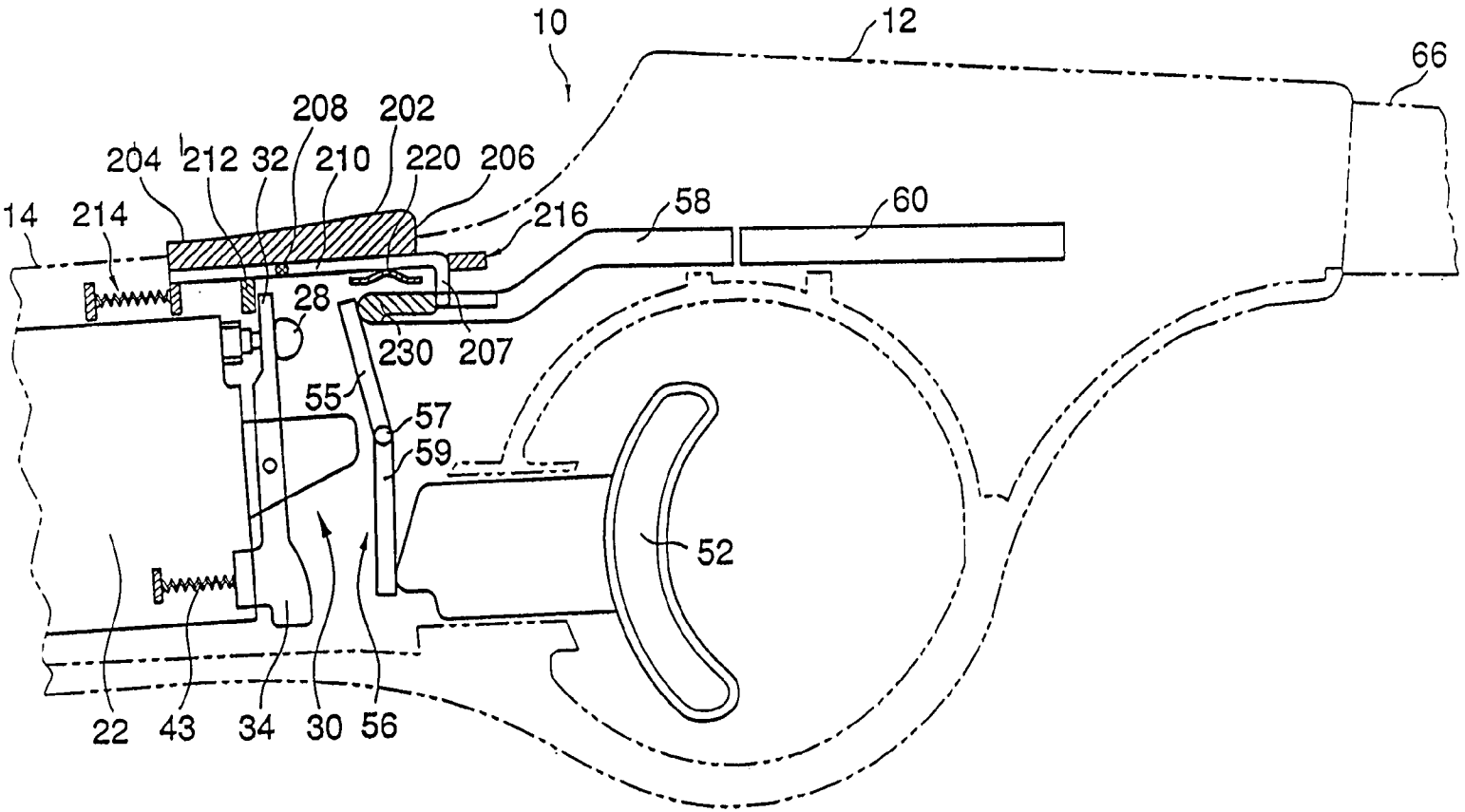
FIG. 4 is a partially fragmented side view similar to FIG. 2, depicting another embodiment of the present invention.

FIG. 4 illustrates another embodiment according to the present invention. Release member 202 comprises a back end 204 and a front end 206 with a finger 207 dependent therefrom. Release member 202 also has a pin 208 adapted to be received in channel 210 defined on housing 12, and a release tab 212 for actuating the valve actuator 30. The back end 204 abuts the housing 12 and may or may not be of cantilevered-like construction as described in the earlier embodiment shown in FIG. 2. The back end 204 may be secured by a spring 214 to handle 14. Preferably spring 214 is a tension spring for biasing the release member 202 in the rearward direction. A body stop 216 on the housing 12 prevents frontward movement of the release member 202 beyond a predetermined distance. The front end 206 of the release member 202 engages a spring 220, which is positioned against the housing 12 for upwardly biasing the front end 206 of the release member 202. Preferably the upward spring 220 is a leaf spring as shown. Alternatively, release member 202 can be connected to the housing 12 in a cantilever manner, as illustrated above, or spring 220 can be a coil spring. The pin 208 secures the release member 202 to the housing 12 of the lighter 10, allowing front-to-back movements of the release member 202 relative to the housing 12.

FIG. 4 shows the lighter 10 in the inoperative state, in which the linking rod 58 is in engagement with finger 207 of front end 206 of the release member 202. Preferably, the linking rod 58 also has a stop 230 disposed thereon to increase the difficulty of operating the lighter 10. When a user pulls the trigger 52 without first depressing front end 206, linking arm 56 rotates in a clockwise direction and pushes linking rod 58 forward. However, since stop 230 on the linking rod 58 abuts finger 207, which in turn abuts body stop 216, operative movement of linking rod 58 is prevented.

To operate the lighter, a user first depresses the release member 202 downward then sliding it forward toward the second end 20 of the lighter 10. The downward movement disengages the front end 206 from the body stop 216 and finger 207 from stop 230, allowing forward movement of release member 202. Sliding the release member 202 toward the front of the lighter 10 moves the release tab 212 in a similar fashion, allowing the release tab 212 to catch the lift end 32 of the valve actuator 30 and to open valve 28 to release fuel from the fuel cell 22. Gaseous fuel, such as butane is released to the nozzle 18. Since finger 207 no longer interferes with stop 230 on the linking rod 58, the user may pull the trigger 52, to actuate a spark. The spark ignites the air/gas mixture released from the nozzle 18 to produce a flame.

When the user releases the release member 202 and the trigger 52, springs 214 and 220 return the release member 202, thereby returning release tab 212 into its original upwardly and backwardly biased position and shutting off the supply of fuel to nozzle 18. This extinguishes the flame emitted from the hole 82. As described above with respect to FIG. 2*a*, the embodiment shown in FIG. 4 may be adapted to release gas without valve actuator 30, when release tab 212 is adapted to directly engage valve 28.

Figure 4A:
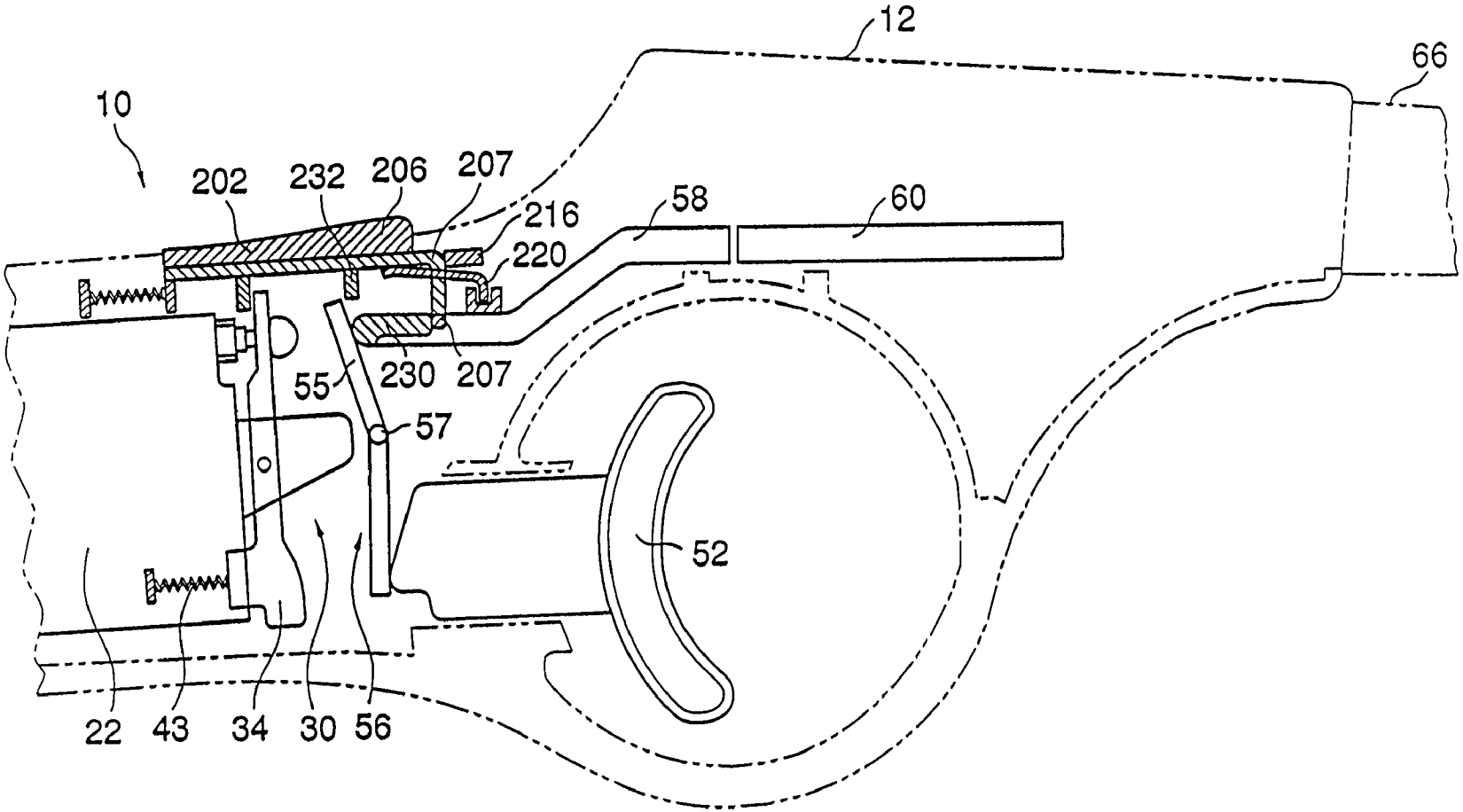
FIGS. 4A and 4B illustrate variations of the embodiment shown in FIG. 4.

A variation of the embodiment in FIG. 4 is shown in FIG. 4A. Latch member 202 comprises a catch 232 dependent therefrom and extending downward as shown. In the inoperative position, catch 232 is out of alignment with end 55 of the linking arm 56. In this embodiment, depressing release member 202 engages catch 232 with end 55 of linking arm 56. Thereafter, pulling of trigger 52 will move catch 232 and assist with the forward sliding of release member 202 and the release of fuel from the fuel cell 22.

Figure 4B:
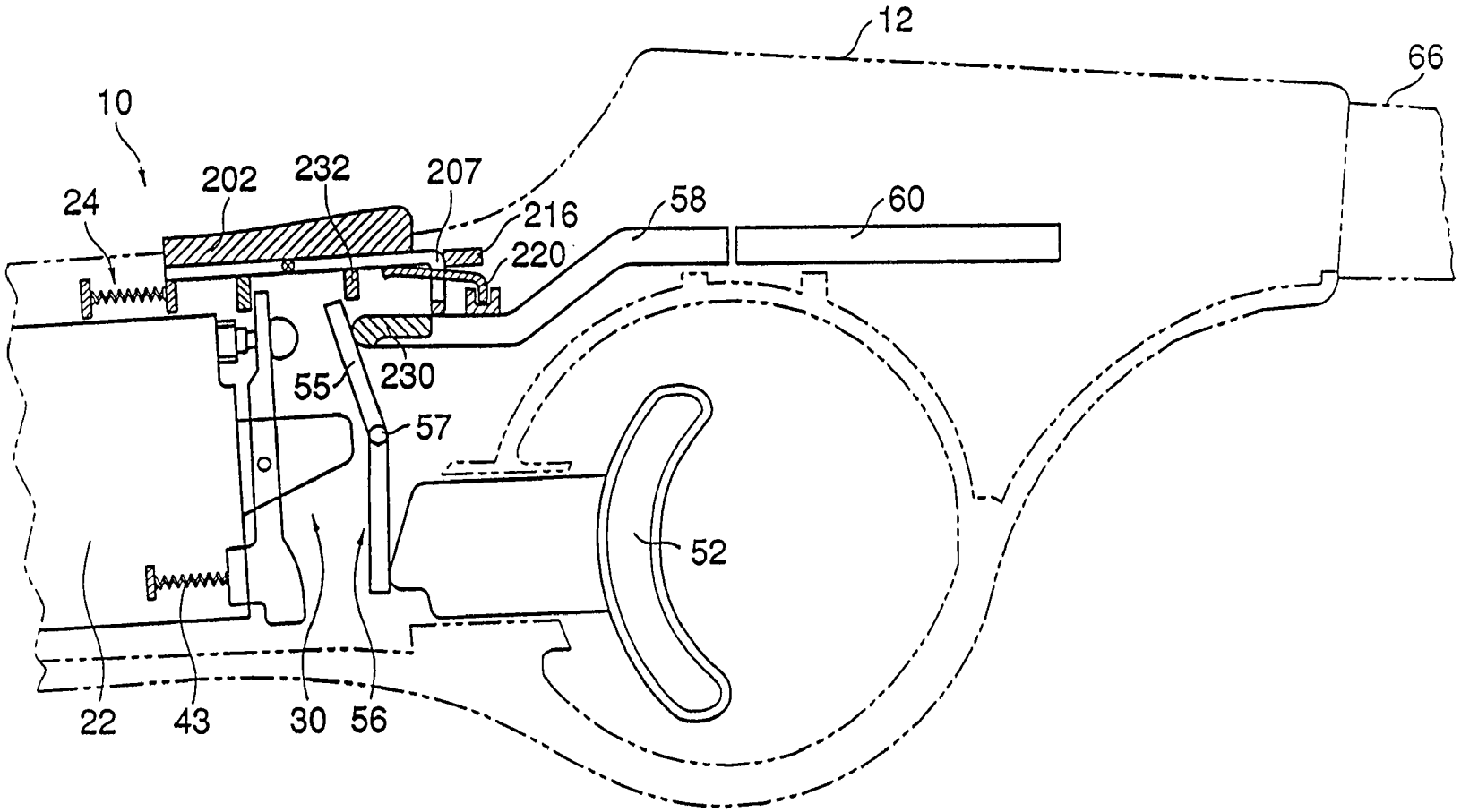

Alternatively as shown in FIG. 4B, finger 207 of release member 202 may be positioned initially above stop 230 on linking rod 58, such that operative movements of trigger 52, linking arm 56 and linking rod 58 are allowed to actuate piezoelectric unit 60 without first actuating the release member 202. However, partial depression of release member 202 brings finger 207 into interference with stop 230, thereby inhibiting operative movement of linking rod 58 to actuate piezoelectric unit 60. If release member 202 is fully depressed to a position, where finger 207 clears stop 230, then linking rod 58 may be pushed forward to actuate piezoelectric unit 60. Release member 202 can then be pushed forward to release fuel, or end 55 of the biasing pivoting mechanism can engage catch 232 to push release member 202 forward to release fuel.

Figure 5:
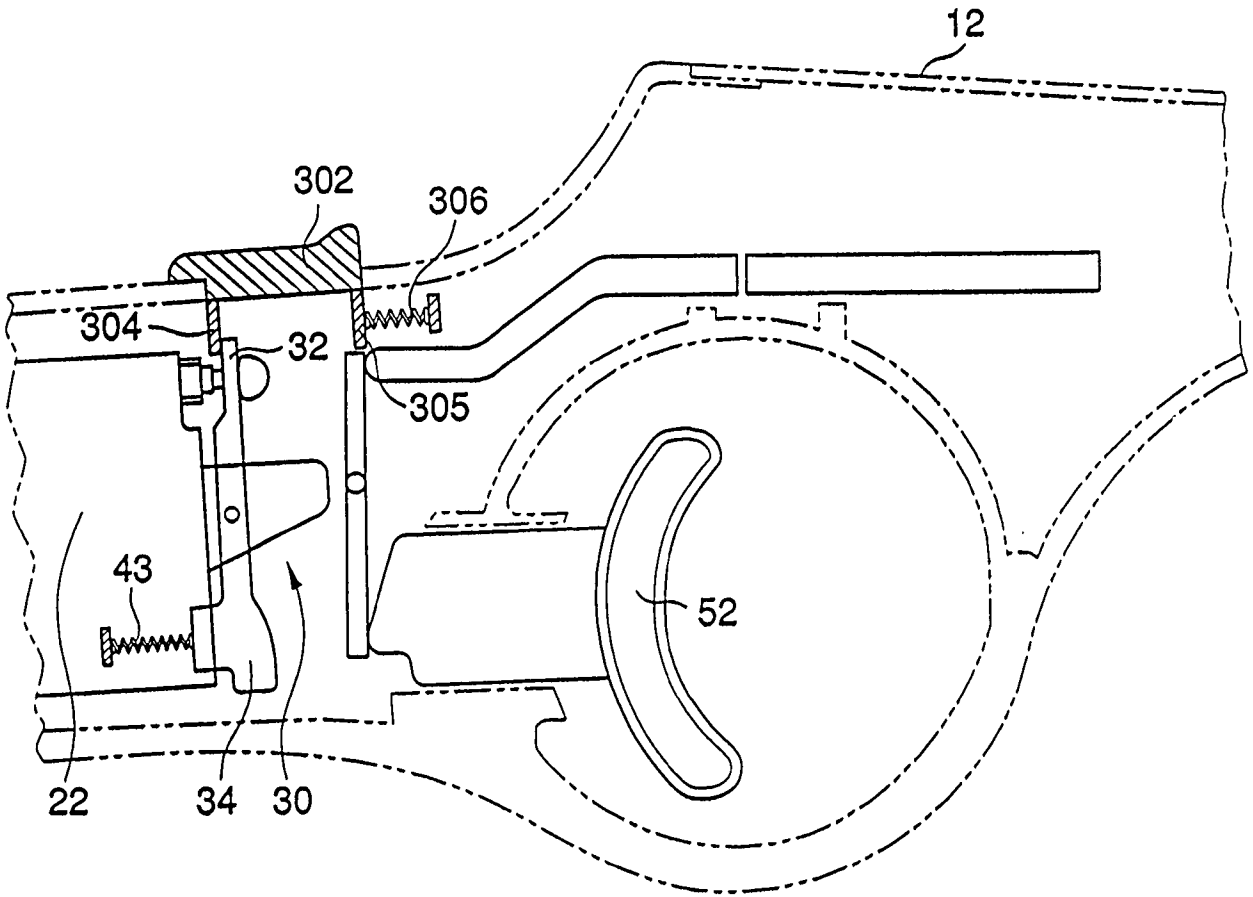
FIG. 5 is a partially fragmented side depicting another alternative embodiment of the present invention.

Referring to FIG. 5, another embodiment according to the present invention has a release member 302 with release tab 304 and spring tab 305. The spring tab 305 is resiliently secured to the housing 12 with compression spring 306 as shown. The spring 306 backwardly biases the release member 302 toward the first end 16 when the release member 302 is in an inoperative state. When a user slides the release member 302 forward toward the second end 20, the release tab 304 engages lift end 32 of the valve actuator 30, allowing the release of fuel from the fuel cell 22. When the user releases release member 302, the spring 306 backwardly biases the release tab 304 and the compression spring 43 biases valve actuator 30 pushing the lift end 32 toward the back end of the lighter 10, closing and shutting off the supply of fuel to nozzle 18. This suspends the release of fuel from the fuel cell 22 and returns the lighter back to the inoperative state. This embodiment can also be adapted for use without valve actuator 30, as fully described above. Furthermore, the release tab may be configured such that it is always in contact with either left end 32 of valve actuator 30 or valve 28, as illustrated in FIG. 5.

Figure 6A:
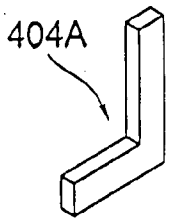
FIGS. 6A, 6B and 6C illustrate other embodiments of this embodiment.
Figure 6B:
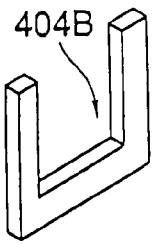
Figure 6C:
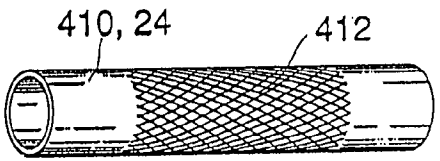
Figure 6:
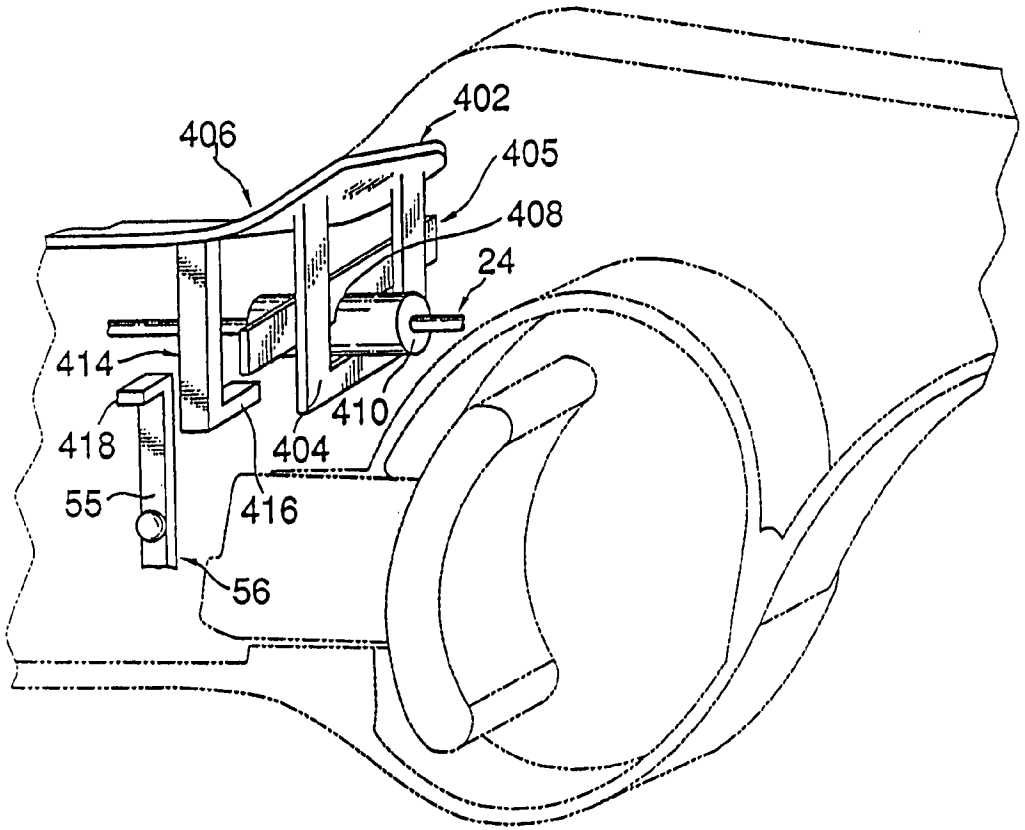
FIG. 6 is a partially fragmented perspective view depicting another embodiment of the present invention.

In another embodiment of the present invention, the cantilevered release member 402, shown in FIG. 6, has a catch 404 disposed toward the interior of the housing 12. The cantilevered construction upwardly biases the release member 402 to its inoperative state. A stationary stop 405, fixedly located in the housing 12, has an arcuate section 408 positioned in its mid-section for receiving a sleeve 410, which is configured to cooperate with the catch 404 for pinching the sleeve 410. Sleeve 410 has a central aperture, which is adapted for fuel conduit 24 to pass through. In the inoperative state, the upwardly biasing catch 404 of release member 402 pinches sleeve 410 and fuel conduit 24 against the stationary stop 405 to prevent the release of fuel.

Preferably, the sleeve 410 is constructed of elastomeric material having sufficient elasticity to withstand the pressure exerted by catch 404 and stationary stop 405. It is further preferred that the sleeve 410 is constructed from a highly elastic material, capable of remaining compressed for long periods of time and returning to its original shape once the pressure from the catch 404 is released. Alternatively, conduit 24 may discontinue at sleeve 410, such that conduit 24 is not exposed to the pressure exerted by catch 404 and stop 405. Conduit 24 may continue from sleeve 410 to the nozzle. Thus, the fuel conduit may be any vessel, which communicates fuel from valve 28 to the nozzle 18. The catch 404 may be U-shaped, as shown in FIG. 6, or L-shaped, as shown in FIGS. 6A and 6B. In addition, the catch 404 can have a modified U-shape where one end of the catch 404 is not connected to release member 402. The L-shaped and modified U-shaped catch configurations provide for easier assembly of the lighter 10 while the U-shaped catch allows more uniform distribution of pressure exerted by the release member 402. Additionally, conduit 24 and/or sleeve 410 may be supported by a stent 412 shown in FIG. 6C, positioned either internal or external to the conduit or sleeve. Such a stent has been used in the medical field to support the walls of a blood vessel or a urethral canal. Examples of this stent are shown in U.S. Pat. Nos. 5,817,100 and 5,443,498.

Release member 402 may also have an extension 414 dependent therefrom. Extension 414 may have lip 416 adapted to interfere with corresponding lip 418 of second end 55 of linking arm 56. The interfering relationship between extension 414 and pivoting linking arm 56 prevents the actuation of the lighter 10 unless the release member 402 is depressed.

In operation, a user depresses the release member 402, thereby lowering the catch 404, releasing the pressure exerted on the sleeve 410 and allowing the flow of fuel from the fuel cell 22 to the nozzle 18. Depressing the release member 402 also lowers the extension 414 and disengages the lip 416 with the lip 418. Thereafter, the user can pull the trigger 52 for generating the spark and igniting the released fuel.

Figure 7:
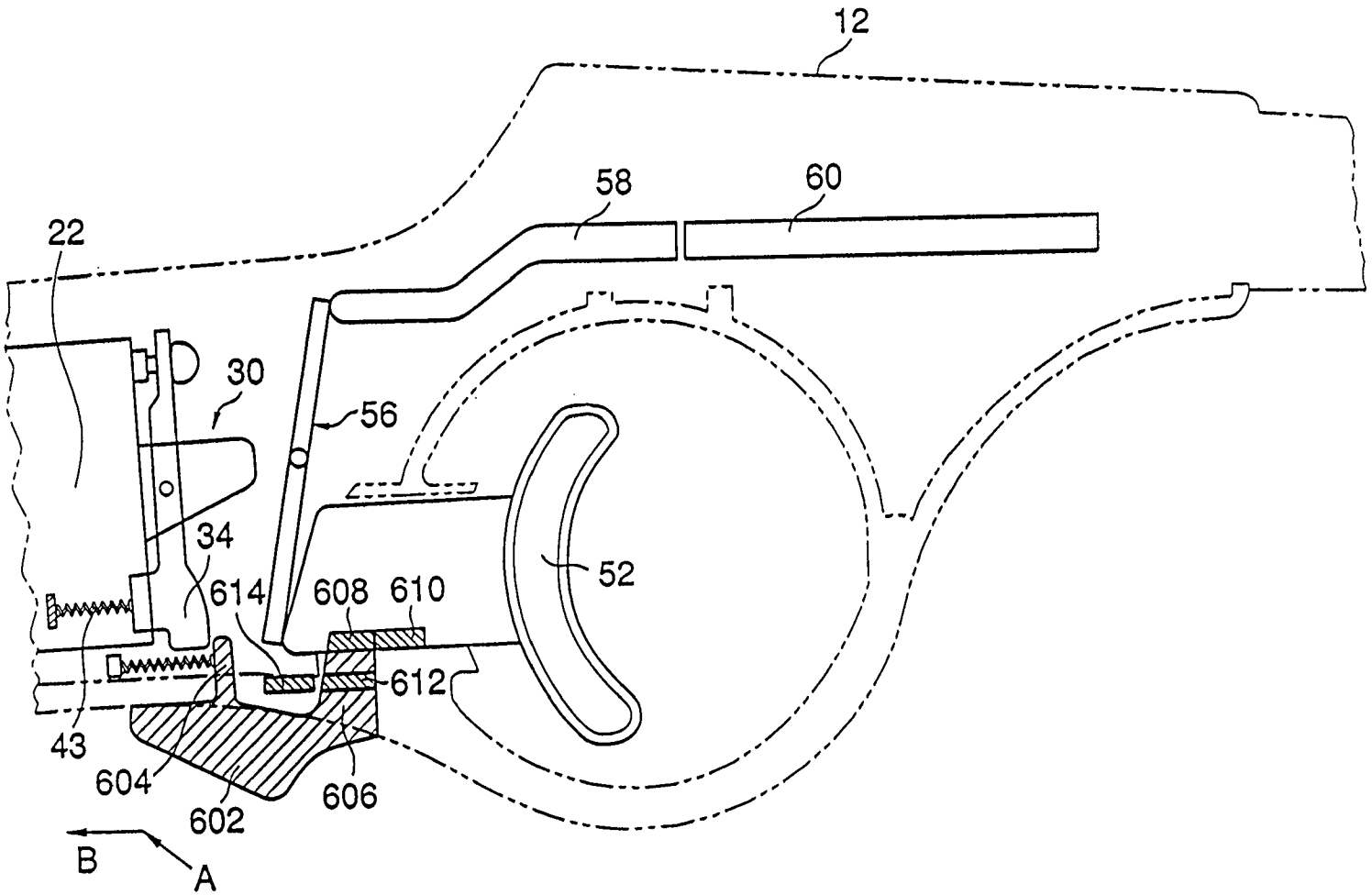
FIG. 7 is a partially fragmented side view depicting another alternative embodiment of the present invention.

Another embodiment of the release member is shown in FIG. 7. The release member 602 comprises a release tab 604 adapted to act on the push end 34 of the valve actuator 30, and a locking tab 606 extending into the housing 12. The locking tab 606 has a lip 608 that normally interferes with a trigger stop 610 positioned on the trigger 52. The locking tab 606 also defines a stop 612 that normally interferes a stop 614 on the housing 12. In the inoperative state, the stop 612 is in alignment with the stop 614 on body 12, such that when a user tries to depress the trigger 52, the trigger stop 610 acts on lip 608 of release member 602. Since stop 612 of release member 602 interferes with stop 614 on body 12, the user cannot depress the trigger 52. In operation, the release member 602 is moved generally in the upward direction shown as arrow A, which moves stop 612 out of alignment with the stop 614, and the user can slide the release member 602 generally backward, shown as arrow B, to actuate the valve actuator 30 and release fuel from the fuel cell 22 to the nozzle 18. In addition, as the release member 602 is displaced, the lip 608 is also displaced from interfering with the trigger stop 610, allowing actuation of the trigger 52. Pulling the trigger 52 at this time will generate a spark igniting the air/gas mixture released earlier in the vicinity of the nozzle 18. Preferably, trigger 52 can't be depressed until fuel is selectively released.

Figure 8:
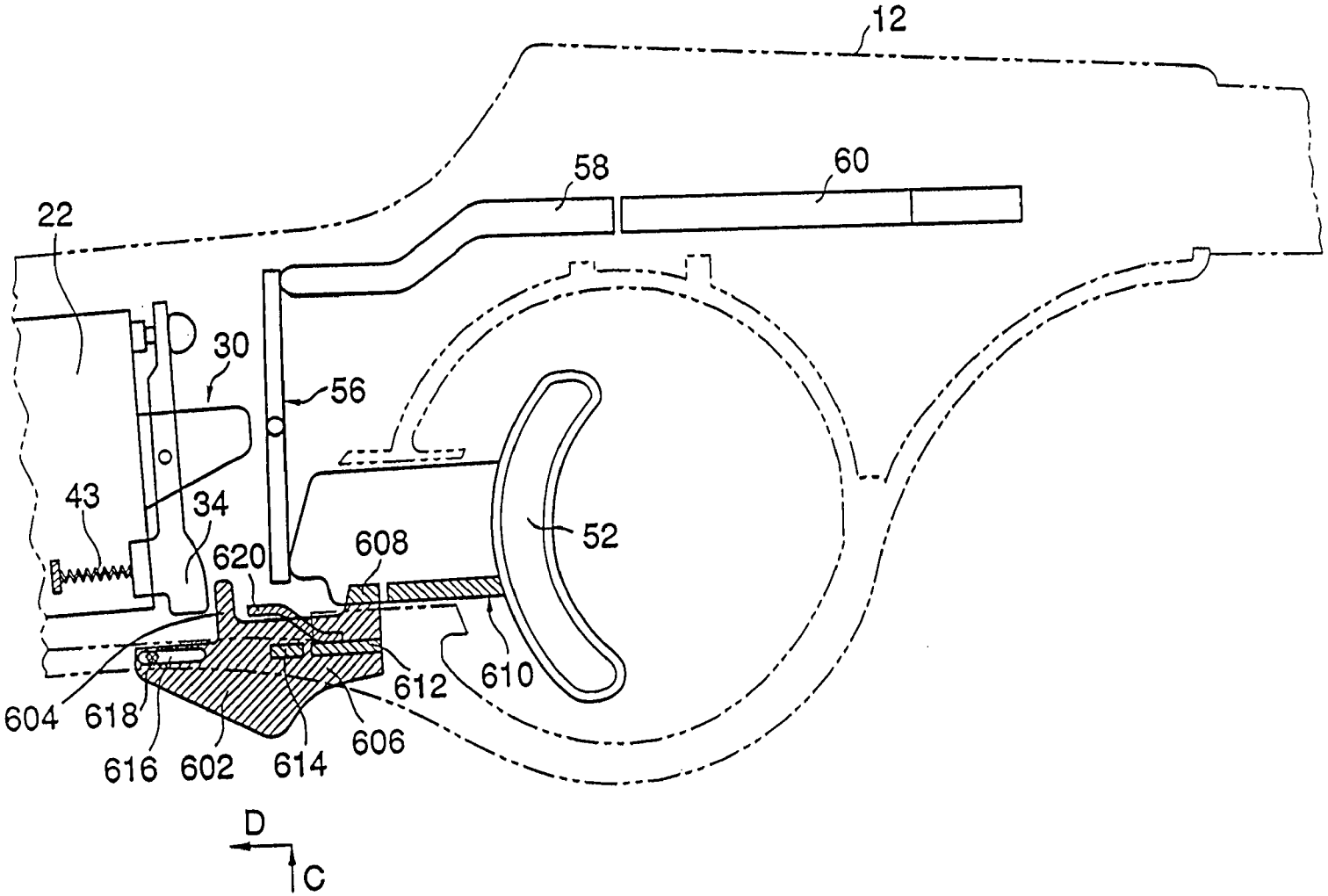
FIGS. 8 and 8A are partially fragmented side views depicting other embodiments.

A variation to the embodiment shown in FIG. 7 is presented in FIG. 8, where release member 602 comprises a release tab 604 adapted to act on push end 34 of the valve actuator 30 and a locking tab 606 extending into the housing 12. Release member 602 further defines a release channel 616 to receive a pin 618, positioned on the housing for slidable movement therein. The pin 618 secures the release member 602 to the housing 12 while allowing movement of the release member 602 relative to the housing 12. In operation, as the release member 602 is moved in an upward direction shown as arrow C, the release member 602 moves in a counter clockwise direction, toward the interior of the housing 12. The upward movement of release member 602 disengages lip 608 from trigger release 610 as described above. The release member 602 is thereafter moved generally backward, shown as arrow D, allowing pin 618 to slide in release channel 616, thereby depressing push end 34 and releasing fuel from the fuel cell 22. A spring 620, shown in FIG. 8A in association with stopper 612, downwardly biases the release member 602 and returns same toward its inoperative position. Alternatively, channel 616 can be a hole allowing pin 618 to pivot therein, and release tab 604 may have a cam surface similar to cam surface 705 shown in FIG. 9, so that pivotal movement of the release member 602 in the counterclockwise direction acts on push end 34 of valve actuator 30 to release gas.

Figure 8A:
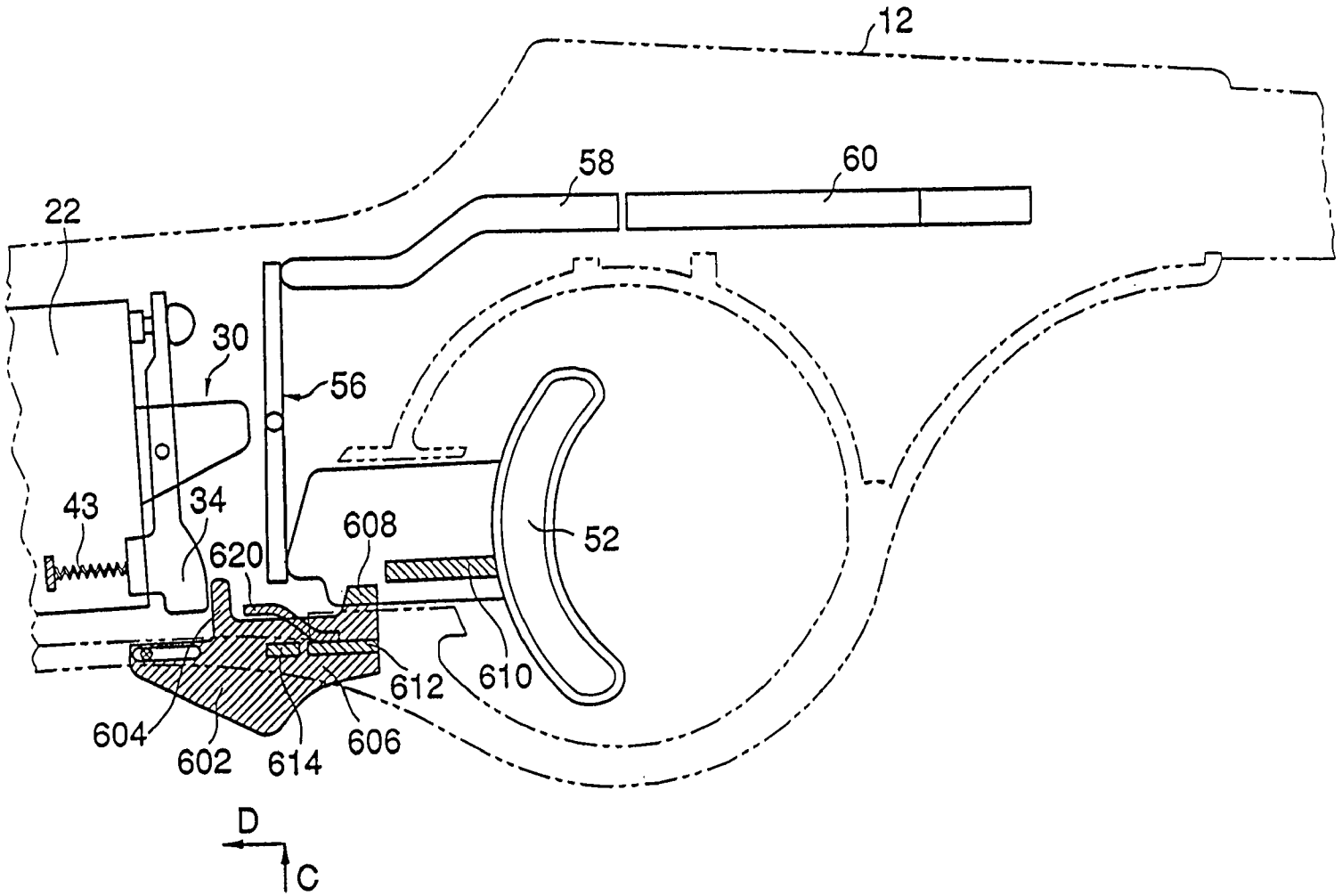

Alternatively, as shown in FIG. 8A, stop 610 on trigger 52 may be positioned initially above lip 608 on release member 602, such that operative movements of trigger 52, biasing linking arm 56 and linking rod 58 are allowed to actuate piezoelectric unit 60, without first actuating the release member 602. However, partial movement of release member 602 in direction C brings stop 610 into interference with lip 608, thereby inhibiting operative movement of trigger 52 to actuate piezoelectric unit 60. If release member 602 is fully moved in direction C such that lip 608 clears stop 610, then trigger 52 can then be pulled to actuate piezoelectric unit 60.

Figure 9:
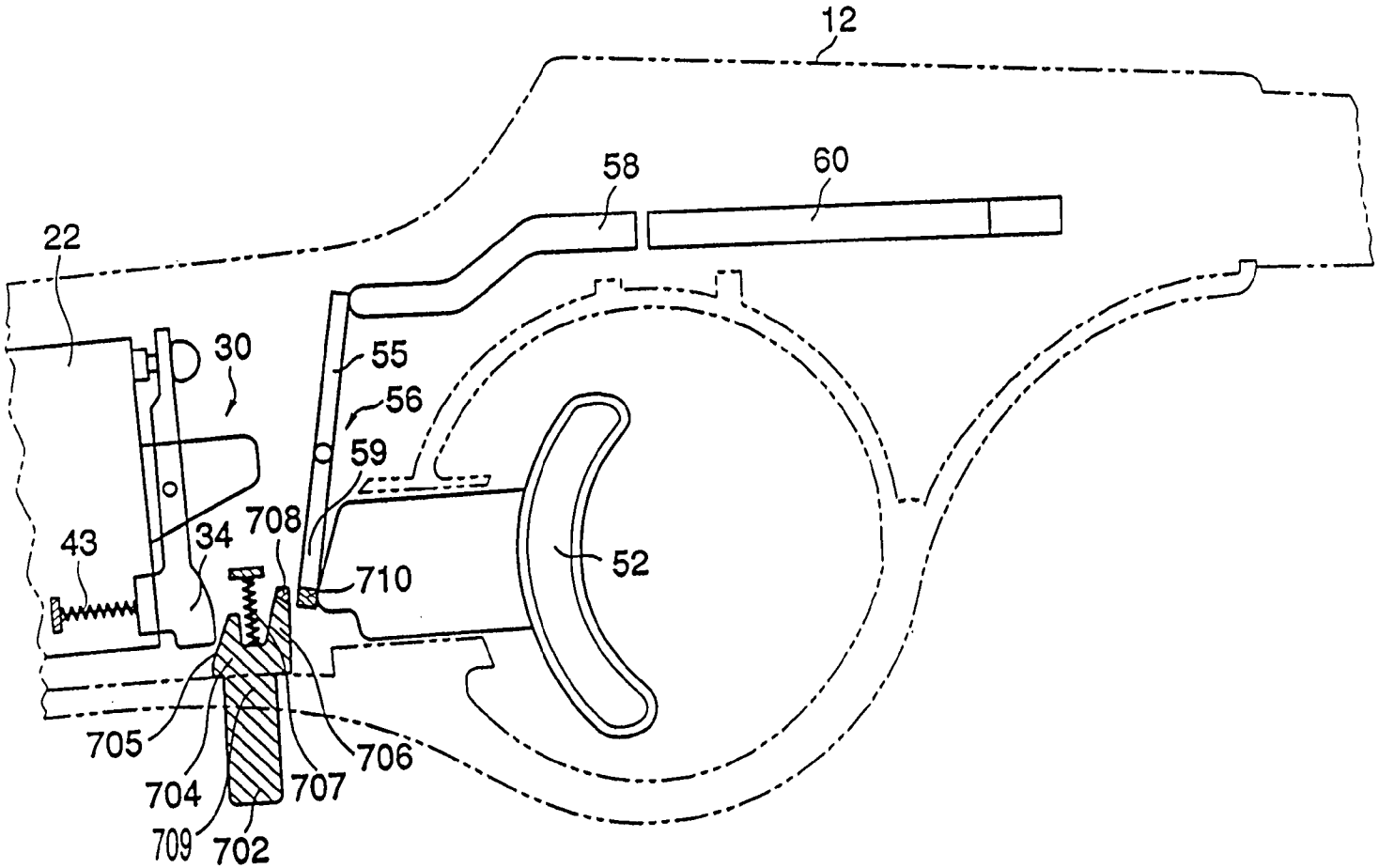
FIGS. 9 and 9A are partially fragmented side views depicting another embodiment of the present invention.

Another embodiment of the release member 702 constructed according to the present invention is shown in FIG. 9. Release member 702 has a release tab 704 and is resiliently biased in a downward direction away from the housing 12 by spring 707. Preferably, the release tab 704 has an upwardly sloping cam surface 705 for actuating the push end 34 of the valve actuator 30 when release member 702 is pushed upwardly against spring 707. In this embodiment, the release member 702 cannot move in the front-back direction due to the interference between release member 702 and housing 12. The release member 702 comprises a blocking member 709 including a blocking tab 706 having lip 708 disposed thereon. Lip 708 normally interferes with a lip 710 disposed on first end 59 of linking arm 56. When a user tries to pull the trigger 52 without first upwardly moving the release member 702, lip 710 of first end 59 interferes with lip 708 of the blocking tab 706, thereby preventing the user from pulling the trigger 52. In operation, the user first upwardly moves the release member 702, and the corresponding upward movement of the sloped surface 705 of the release tab 704 depresses the press end 34 to release fuel gas. Moving the release member 702 upwardly also moves the lip 708 out of alignment with lip 710. Therefore, the user may pull the trigger 52 to generate a spark to ignite the released fuel. Preferably, trigger 52 can't be depressed until fuel is selectively released.

Figure 9A:
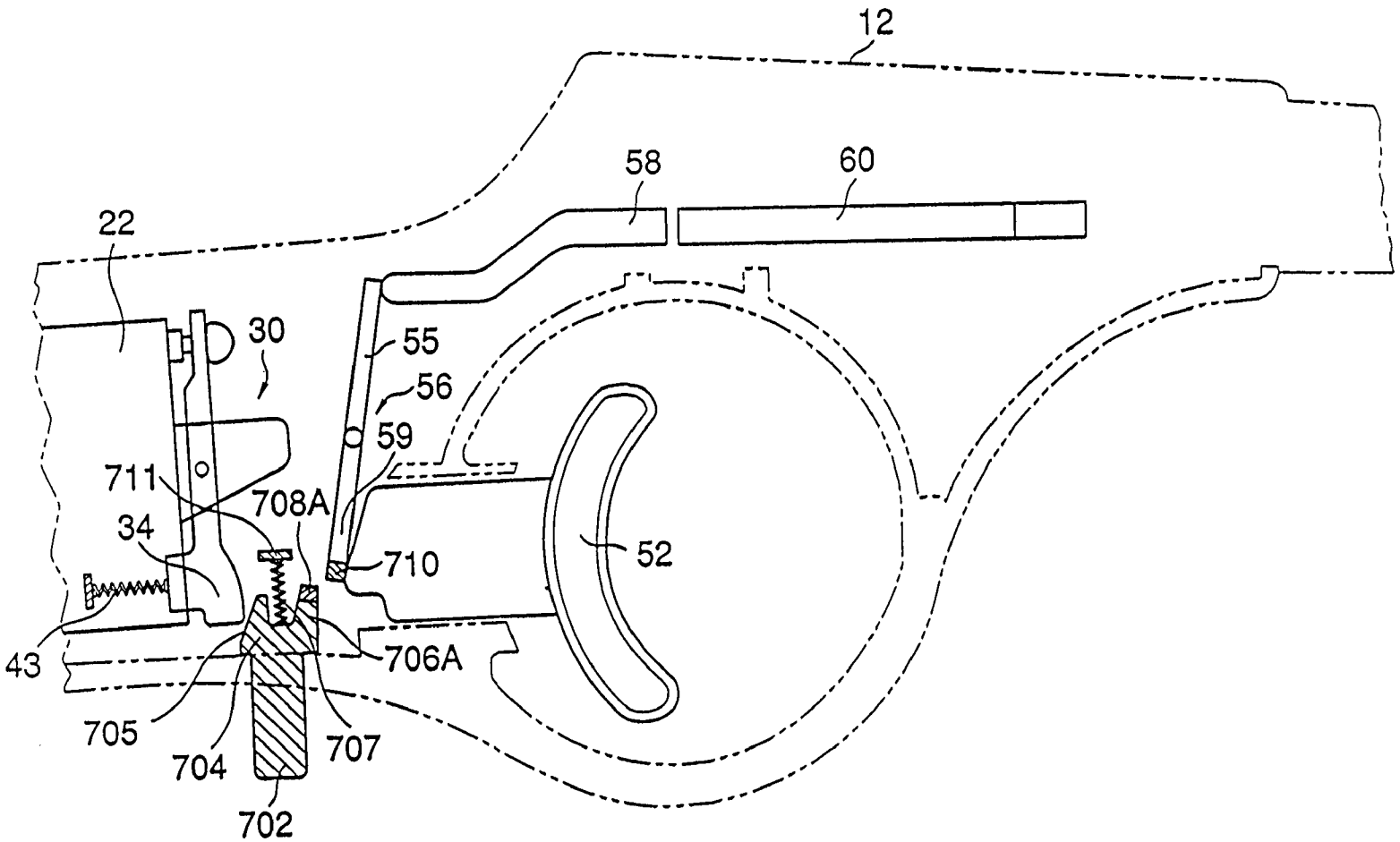

Alternatively, lip 708A of release member 702 may be initially positioned below lip 710 of linking arm 56 as shown in FIG. 9A, such that operative movement of linking arm 56 is allowed to actuate piezoelectric unit 60 without upward movement of release member 702. However, partial upward movement of release member 702 brings lip 708A into interference with lip 710, thereby inhibiting operative movement of linking arm 56 to actuate piezoelectric unit 60. If release member 702 is fully moved upward, such that lip 708A clears lip 710, then linking arm 56 is movable to actuate piezoelectric unit 60.

Figure 10:
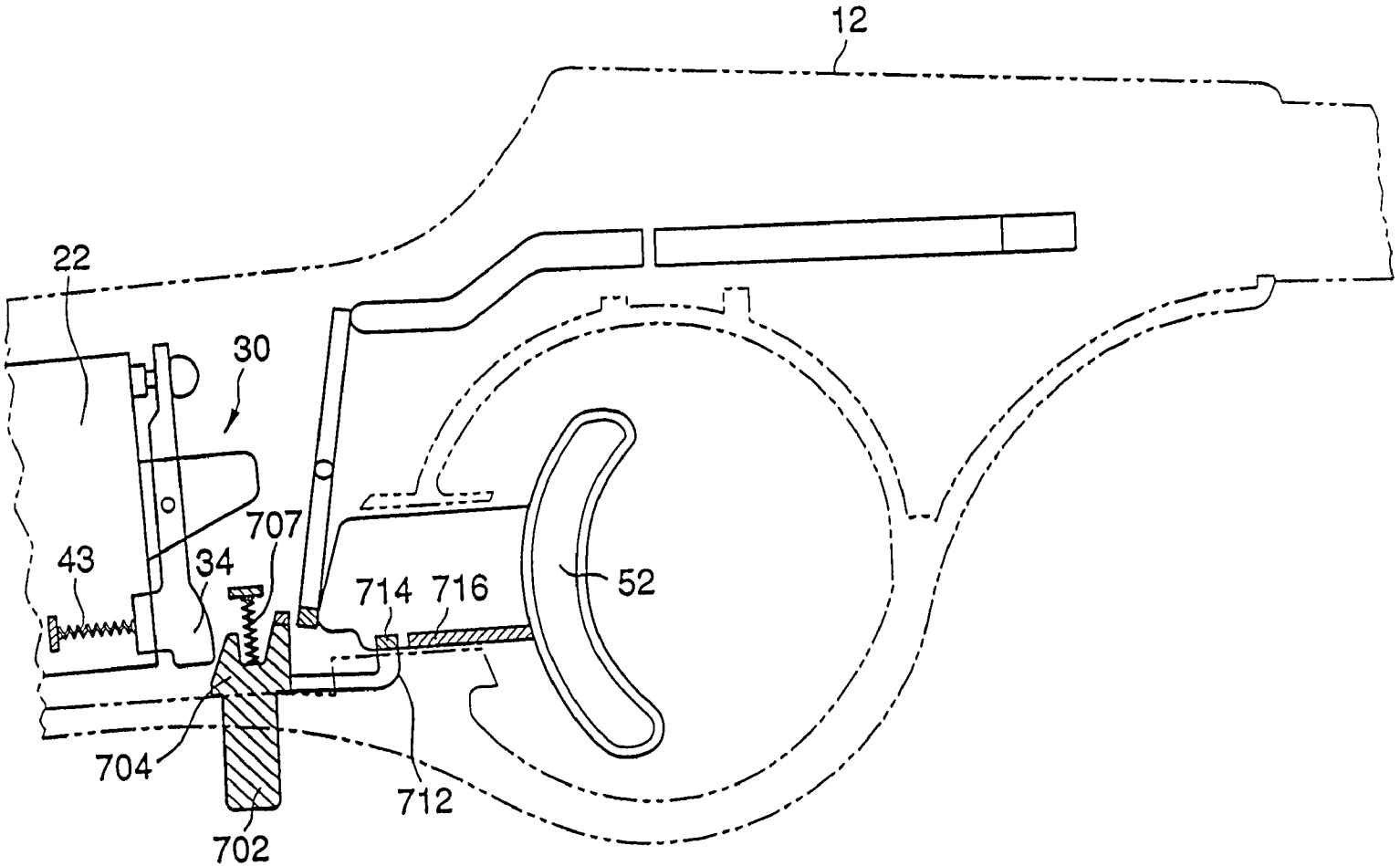
FIGS. 10 and 10A are partially fragmented side views of another embodiment of the present invention.
Figure 10A:
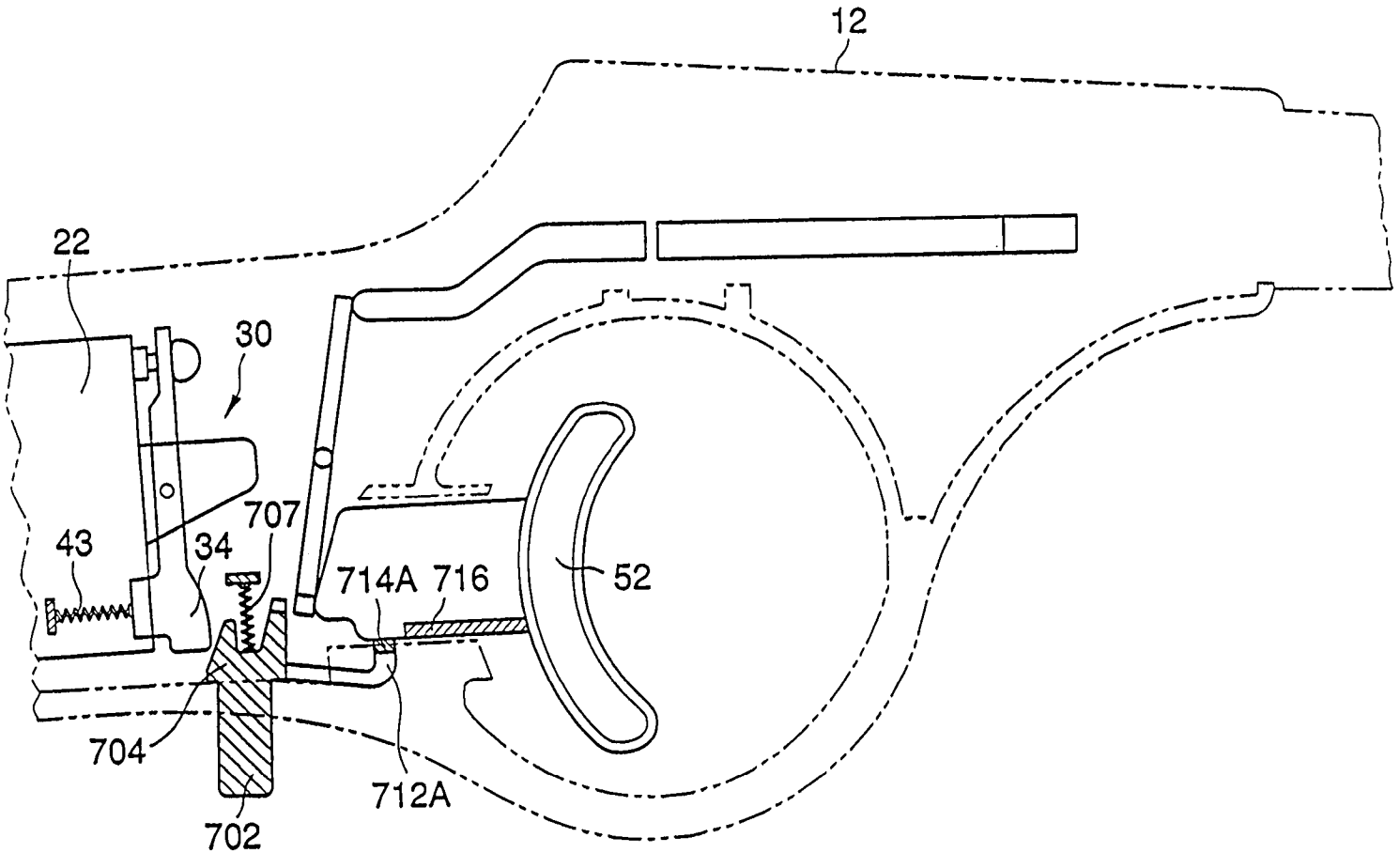

Alternatively, release member 702 may have arm 712 with blocking tab 714 configured and dimensioned to block the movement of trigger 52 as shown in FIG. 10. Upward movement of release member 702 to release fuel, as described above, moves blocking tab 714 out of engagement with trigger stop 716, thereby allowing operative movement of trigger 52. Alternatively, blocking tab 714A of release member 702 may be positioned initially below trigger stop 716, as shown in FIG. 10A, such that operative movement of trigger 52 is allowed without movement of release member 702. However, partial upward movement of release member 702 brings blocking tab 714A into interference with trigger stop 716. If release member 702 is moved fully upward, such that blocking tab 714A clears trigger stop 716, trigger 52 can then be pulled to actuate piezoelectric unit 60.

Figure 11:
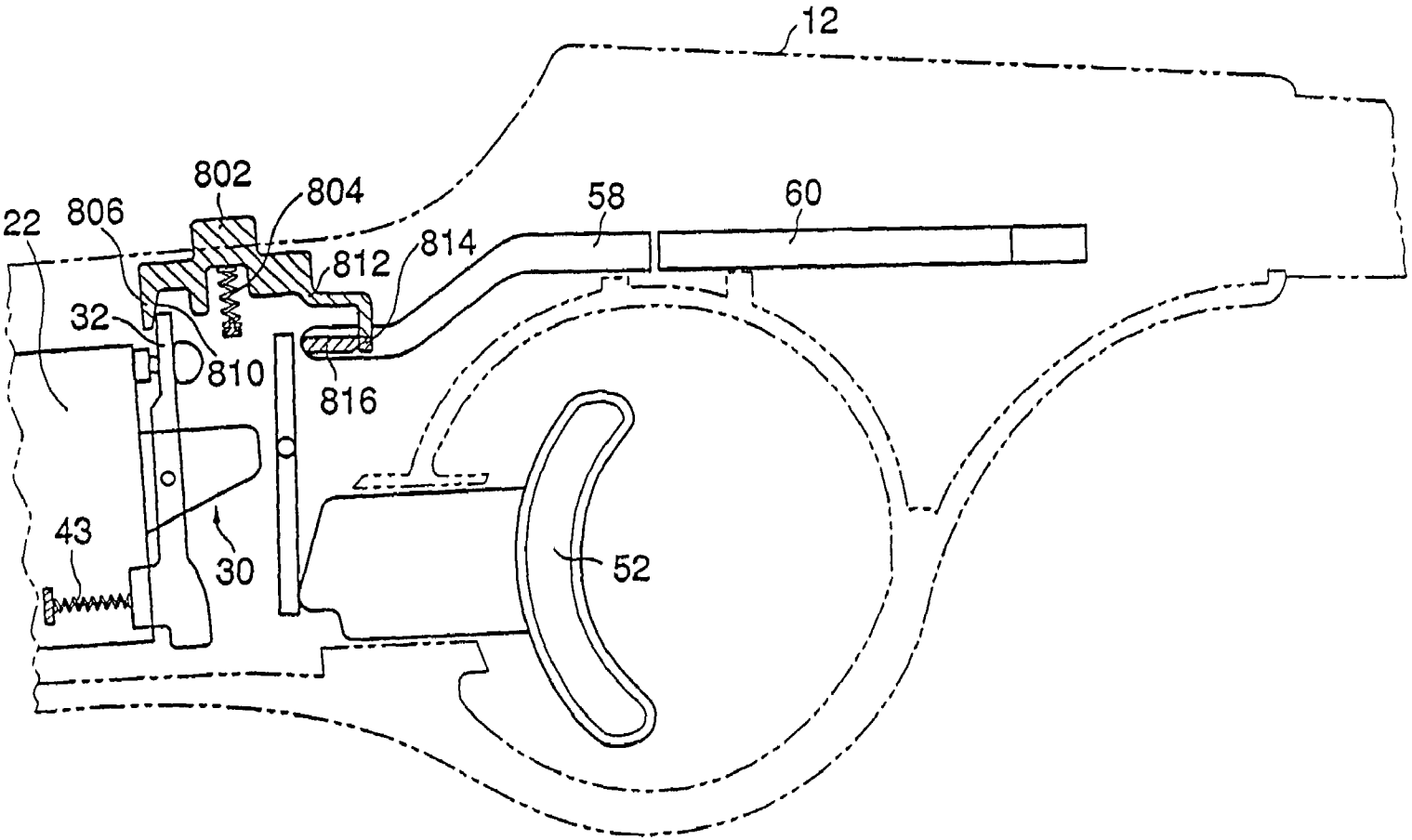
FIGS. 11 and 11A are partially fragmented side views depicting yet another embodiment of the present invention.

FIG. 11 shows another embodiment constructed according to the present invention. The release member 802 is operatively connected to the upper portion of the housing 12 and is upwardly biased by a spring 804 attached to the housing. Preferably, release member 802 has a release tab 806 with a sloping surface 810 for actuating the lift end 32 of the valve actuator 30 when release member 802 is pushed downwardly against spring 804. In this embodiment, the release member 802 cannot move in the front-back direction due to the interference between release member 802 and housing 12. The release member 802 includes a blocking tab 812 having lip 814 disposed thereon. As shown in FIG. 11, in the initial position lip 814 interferes with stop 816 on linking rod 58. If a user pulls trigger 52 without first depressing release member 802 to move lip 814 out of engagement with stop 816, forward movement of linking rod 58 is prevented and no spark is generated.

Figure 11A:
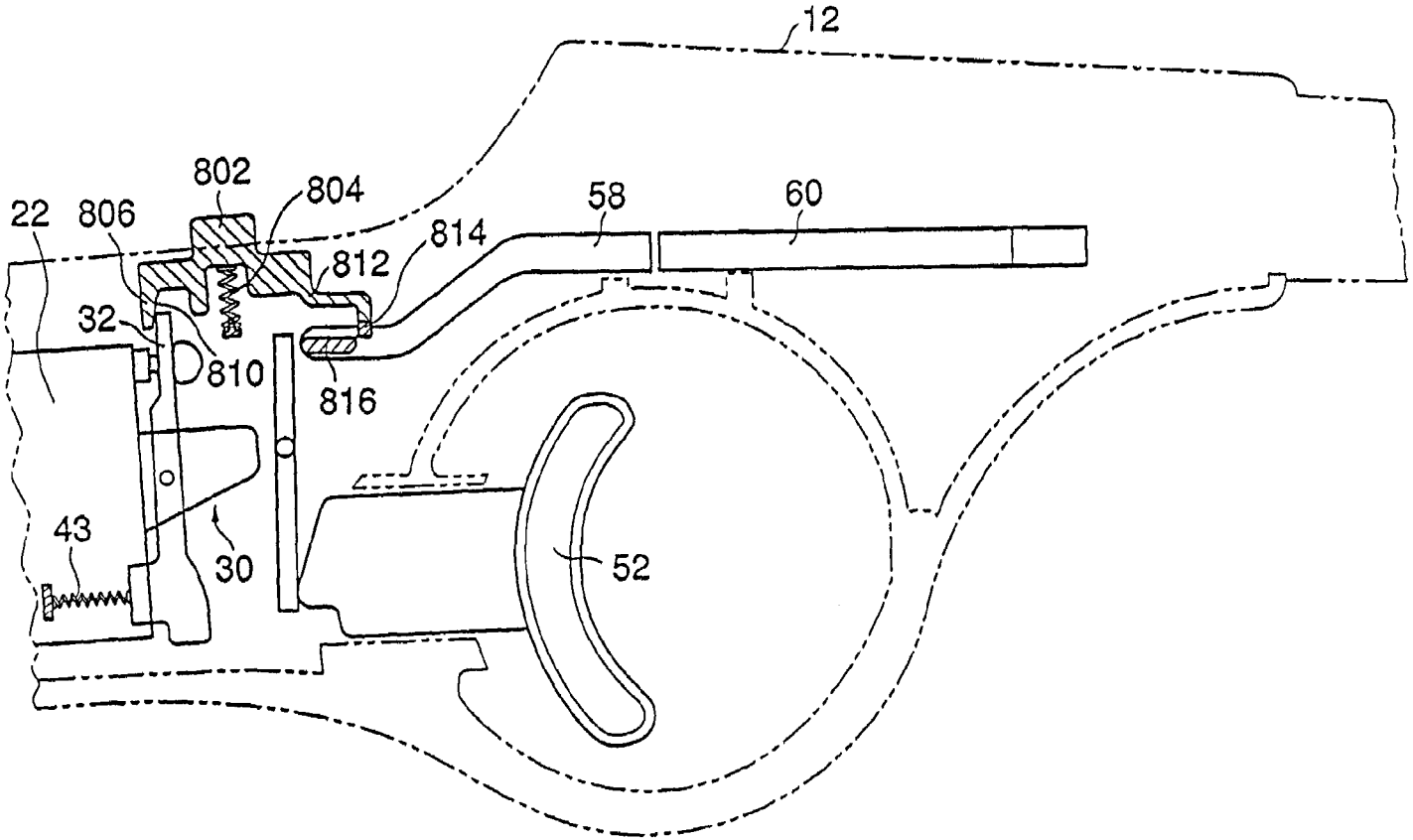

Alternatively, lip 814 is initially located above stop 816 of linking rod 58, as shown in FIG. 11A. A user may pull the trigger 52 without first downwardly pushing the release member 802, thereby generating a spark. However, since no fuel gas is released no flame is produced. In operation, the release member 802 is first moved downwardly and the corresponding downward movement of the sloped surface 810 of the release tab 806 lifts the lift end 32 to begin the release of fuel gas. At this state, the lip 814 is in alignment with stop 816, interfering with the pulling of trigger 52 and providing an intermediate blocking mechanism in the operation of the lighter. Further downward movement of the release member 802 moves the lip 814 out of alignment with stop 816, allowing the user to pull the trigger 52 to generate a spark to ignite the released fuel.

Figure 12:
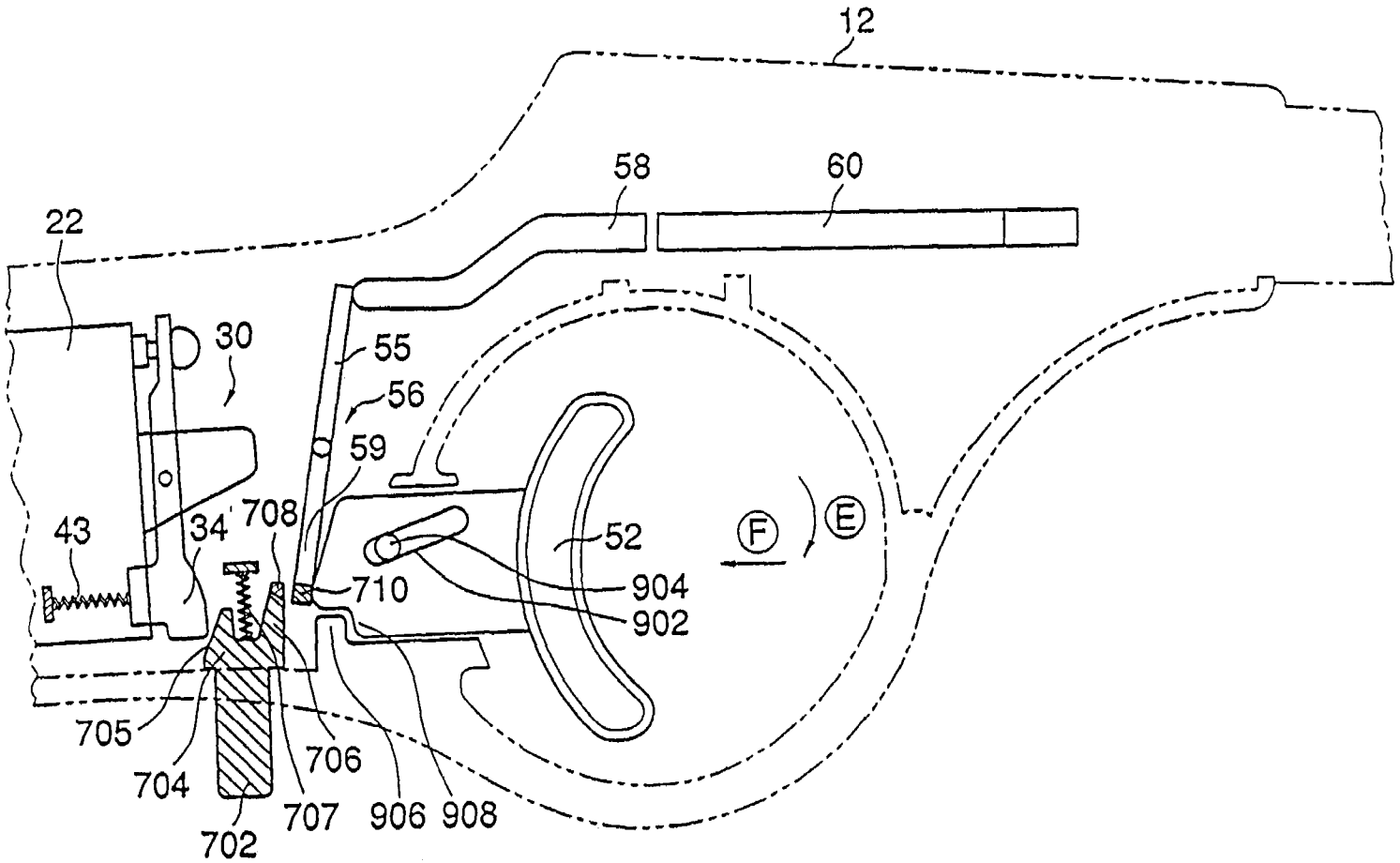
FIGS. 12 and 12A disclose yet another embodiment of the present invention.

FIG. 12 discloses another aspect of the present invention. Trigger 52 defines a substantially oval shaped channel 902 adapted to receive a pin 904, which is fixedly attached to the lighter body. The lighter body also has stop member 906, which normally interferes with shoulder 908 of trigger 92. This interference raises the difficulty of activating trigger 52, by preventing the normal backward movement of the trigger until stop member 906 is moved out of interference with shoulder 908. To activate the trigger, the user first rotates the trigger in direction E, as shown in FIG. 12. This movement brings shoulder 908 out of interference with stop 906. The user then may move trigger 52 backward along direction F to act on linking arm 56 to actuate piezoelectric mechanism 60. FIG. 12 illustrates an example of this embodiment in combination with the embodiment shown in FIG. 9. However, this embodiment can be employed singly or in combination with any of the other embodiments described above to increase the level of difficulty of operating the lighter.

Figure 12A:
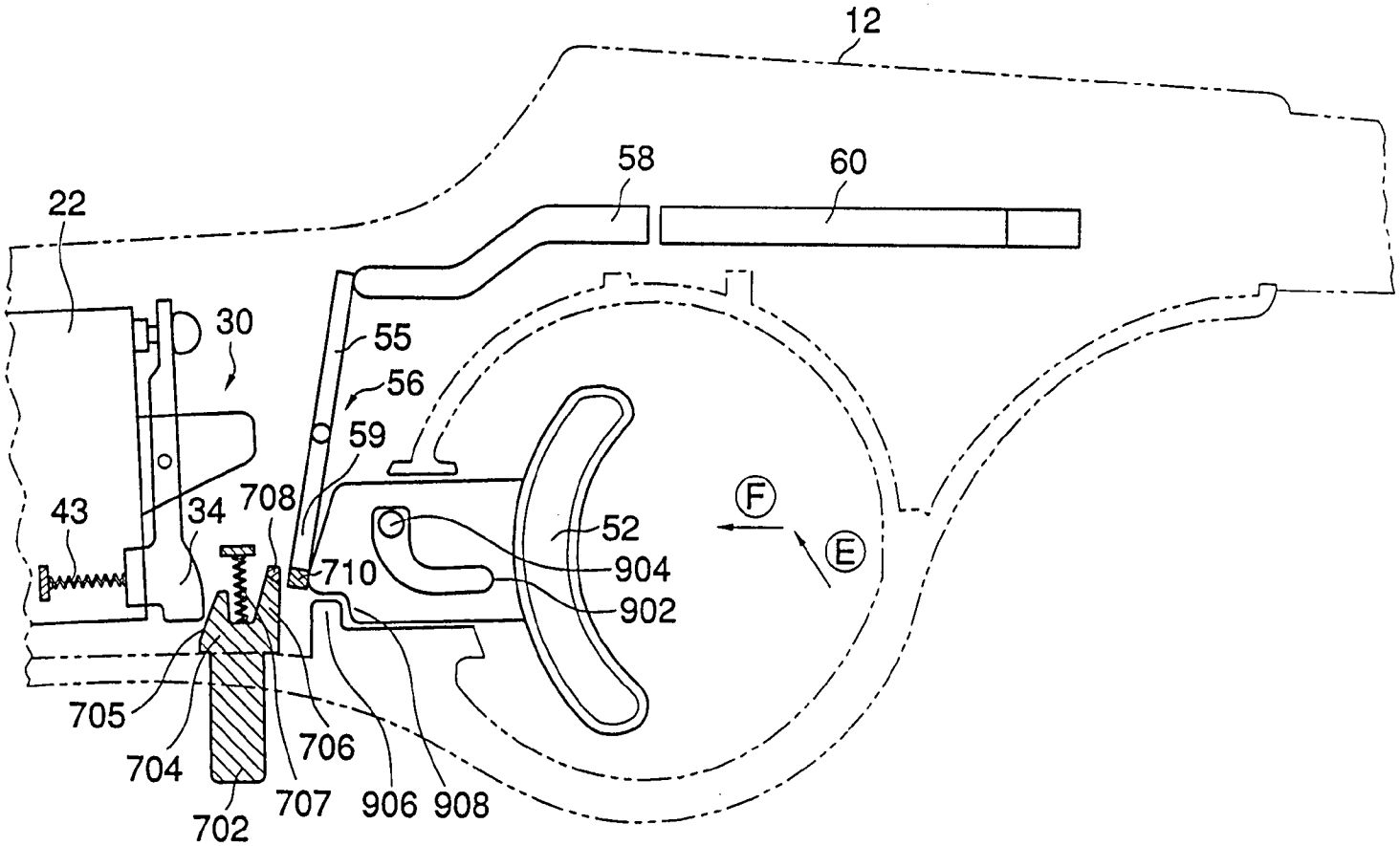

FIG. 12A illustrates a modification of FIG. 12. Pin 904 is received in channel 902, which has an arcuate shape. To actuate the trigger, the user first moves the trigger in the direction E to bring shoulder 908 out of interference with stop 906. The user may then move the trigger in the direction F to actuate the trigger.

While various descriptions of the present invention are described above, it should be understood that the various features can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A utility lighter comprising:

a housing having a main body portion and a rod-like portion extending from the main body portion, the rod-like portion having a nozzle at its end;

a fuel supply container disposed within the main body portion;

a conduit for transporting fuel from the supply container to the nozzle;

a valve mechanism for controlling release of fuel to the nozzle;

a piezoelectric unit for generating a spark near the nozzle to ignite the fuel;

a trigger having a first portion accessible by a user, and a second portion operatively associated with the piezoelectric unit, the trigger being moveable from an initial position to a secondary position such that movement of the trigger from the initial position to the secondary position actuates the piezoelectric unit to produce the spark adjacent the nozzle; and a release member exposed to the outside of the housing, the release member having a first end and an unsupported second end so that the user can act on the second end to move the release member from a first position to a second position which releases the fuel to the nozzle.

2. The lighter of claim 1, wherein the first end of the release member is slidably supported by the housing.

3. The lighter of claim 1, wherein the first end of the release member is sized and configured to be received in a channel formed in the housing.

4. The lighter of claim 3, wherein the first end of the release member is slidable with respect to the channel.

5. The lighter of claim 1, wherein the release member is biased towards the first position.

6. The lighter of claim 1, wherein the release member is in the form of a cantilever member so that the second end is depressible with respect to the housing.

7. The lighter of claim 6, wherein the second end of the cantilever member is depressible and slidable with respect to the housing.

8. The lighter of claim 1, wherein the release member is made from a resilient material.

9. The lighter of claim 1, wherein the release member includes a tab operatively associated therewith for directly or indirectly contacting the valve mechanism to release fuel from the fuel supply container as the release member is moved from the first position to the second position.

10. The lighter of claim 9, wherein, in the first position, the tab is not aligned with the valve mechanism.

11. The lighter of claim 10, wherein depression of the second end of the release member aligns the tab with the valve mechanism such that subsequent movement of the release member from the first position to the second position releases fuel from the fuel supply container.

12. The lighter of claim 1, wherein the valve mechanism includes a valve and a valve actuator, the valve actuator being configured and adapted so that the release member acts on an end of the valve actuator to move the valve for releasing fuel from the fuel supply container.

13. The lighter of claim 1, wherein the release member directly contacts the valve for releasing fuel from the fuel supply container.

14. The lighter of claim 1, wherein the release member includes a blocking portion operatively associated with a stop member so that the release member is prevented from moving from the first position to the second position until the blocking portion is moved with respect to the stop member.

15. The lighter of claim 14, wherein the release member must be moved in a first direction to move the blocking portion out of alignment with the stop member and then moved in a second direction to move the release member from the first position to the second position.

16. The lighter of claim 1, wherein the release member includes a blocking portion configured to interfere with the actuation of the piezoelectric mechanism when the release member is partially actuated, and configured not to interfere with the actuation of the piezoelectric mechanism when the release member is fully actuated.

17. The lighter of claim 1, wherein the release member is moved from the first position to the second position by way of a sliding movement with respect to the housing so that the release member may directly or indirectly contact the valve mechanism.

18. The lighter of claim 1, wherein the second end of the release member is resiliently biased.

19. The lighter of claim 1, wherein the user may act on the second end of the release member to flex the release member.

20. The lighter of claim 19, wherein the user first flexes and then slides the release member.

21. The lighter of claim 1, wherein the user moves the release member in a first direction and then a second direction in order to move the release member from the first position to the second position.

22. The lighter of claim 21, wherein the movement of the release member in the second direction is substantially perpendicular to the movement of the release member in the first direction.

23. The lighter of claim 22, wherein the trigger moves the release member in the second direction.

24. A lighter comprising:

a housing having a nozzle with an outlet, said housing further including a fuel supply in communication with a valve mechanism adapted for selective release of fuel to the nozzle outlet;

a release member exposed to the outside of the housing so that it is actuatable by a user, the release member being moveable from a first position to a second position so that the release member directly or indirectly contacts the valve mechanism such that movement of the release member from the first position to the second position releases the fuel; and a trigger spaced from the release member and having at least a portion extending from the housing, the trigger being moveable from an initial position to a secondary position so that the trigger directly or indirectly contacts an ignition mechanism to actuate the ignition mechanism to produce a spark to ignite the released fuel;

wherein the release member is in the form of a cantilever member having a first end supported by the housing and a second unsupported end that is depressible by the user with respect to the housing.

25. The lighter of claim 24, wherein the first end of the release member is slidably supported by the housing.

26. The lighter of claim 24, wherein the first end of the release member is sized and configured to be received in a channel formed in the housing.

27. The lighter of claim 26, wherein the first end of the release member is slidable with respect to the channel.

28. The lighter of claim 24, wherein the release member is biased towards the first position.

29. The lighter of claim 24, wherein the release member is made from a resilient material.

30. The lighter of claim 24, wherein the release member includes a tab operatively associated therewith for directly or indirectly contacting the valve mechanism to release fuel from the fuel supply container as the release member is moved from the first position to the second position.

31. The lighter of claim 30, wherein, in the first position, the tab is not aligned with the valve mechanism.

32. The lighter of claim 31, wherein depression of the second end of the release member aligns the tab with the valve mechanism such that subsequent movement of the release member from the first position to the second position releases the fuel.

33. The lighter of claim 24, wherein the valve mechanism includes a valve and a valve actuator, the valve actuator being configured and adapted so that the release member acts on an end of the valve actuator to move the valve for releasing the fuel.

34. The lighter of claim 24, wherein the release member includes a blocking portion operatively associated with a stop member so that the release member is prevented from moving from the first position to the second position until the blocking portion is moved with respect to the stop member.

35. The lighter of claim 34, wherein the release member must be moved in a first direction to move the blocking portion out of alignment with the stop member and then moved in a second direction to move the release member from the first position to the second position.

36. The lighter of claim 24, wherein the release member includes a blocking portion configured to interfere with the actuation of the ignition mechanism when the release member is partially actuated, and configured not to interfere with the actuation of the ignition mechanism when the release member is fully actuated.

37. The lighter of claim 24, wherein the release member is moved from the first position to the second position by way of a sliding movement with respect to the housing so that the release member may directly or indirectly contact the valve mechanism.

38. The lighter of claim 24, wherein the second end of the release member is resiliently biased.

39. The lighter of claim 24, wherein the user may act on the second end of the release member to flex the release member.

40. The lighter of claim 39, wherein the user first flexes and then slides the release member.

41. The lighter of claim 24, wherein the user moves the release member in a first direction and then a second direction in order to move the release member from the first position to the second position.

42. The lighter of claim 41, wherein the movement of the release member in the second direction is substantially perpendicular to the movement of the release member in the first direction.

43. The lighter of claim 42, wherein the trigger moves the release member in the second direction.

* * * * *